US006260787B1

(12) United States Patent
Michel et al.

(10) Patent No.: US 6,260,787 B1
(45) Date of Patent: Jul. 17, 2001

(54) APPARATUS AND METHOD FOR UNLOADING REWOUND ROLLS

(75) Inventors: John Michel, Randolph; John Wilkes, Hamburg; Michael Yermal, Dover, all of NJ (US)

(73) Assignee: John Dusenbery Co., Inc., Randolph, NJ (US)

( * ) Notice: Subject to any disclaimer, the term of this patent is extended or adjusted under 35 U.S.C. 154(b) by 0 days.

(21) Appl. No.: 09/360,987

(22) Filed: Jul. 26, 1999

(51) Int. Cl.[7] ..... B65H 18/04; B65H 18/10; B65H 19/30

(52) U.S. Cl. ..... 242/530.4; 242/533.3; 242/533.7; 242/534.2; 242/547

(58) Field of Search ..... 242/530, 530.4, 242/533, 533.2, 533.3, 533.7, 533.8, 534, 534.2, 547

(56) References Cited

U.S. PATENT DOCUMENTS

| | | | | |
|---|---|---|---|---|
| 2,198,644 | * | 4/1940 | Wettengel | 242/533.3 |
| 3,977,619 | * | 8/1976 | Nagata et al. | 242/534.2 |
| 4,208,019 | * | 6/1980 | Dusenbery | 242/530.4 |
| 4,238,082 | * | 12/1980 | Lund | 242/530.4 |
| 4,271,959 | * | 6/1981 | Eibe | 242/533.3 |
| 4,346,852 | * | 8/1982 | Kawada et al. | 242/530.4 |
| 4,431,142 | * | 2/1984 | Kataoka | 242/530.4 |
| 4,438,889 | * | 3/1984 | Schonmeier | 242/534.2 |
| 4,491,283 | * | 1/1985 | Pav et al. | 242/533.7 |
| 4,611,769 | * | 9/1986 | Orbach | 242/530.4 |
| 4,682,929 | * | 7/1987 | Kataoka | 242/533.3 |
| 5,157,948 | * | 10/1992 | Rikiishi et al. | 242/533 |
| 5,308,217 | * | 5/1994 | Pienta | 242/533 |

* cited by examiner

*Primary Examiner*—John M. Jillions
(74) *Attorney, Agent, or Firm*—Thomas L. Adams

(57) ABSTRACT

A rewinder for rewinding a web into one or more rolls on separate cores, includes at least one rewinding mandrel having a distal end. The rewinder also has a supply device for supplying the web to the rewinding mandrel, and a drive device. The drive device can (a) rotate the rewinding mandrel in order to wind at least a portion of the web onto the rewinding mandrel, and (b) axially retract the mandrel to unload the portion of the web wound on the mandrel. Also included is a holder for holding the one or more rolls. The rewinder also has a lifter for (a) raising the holder to support the portion of the web wound on the mandrel, and (b) lowering the holder. This rewinding mandrel is rotated in order to wind at least a portion of the web onto the rewinding mandrel. The holder is then raised to support the portion of the web wound on the mandrel. Next, the mandrel is axially retracted to unload the portion of the web wound on the mandrel, before lowering the holder.

61 Claims, 16 Drawing Sheets

APPARATUS AND METHOD FOR UNLOADING REWOUND ROLLS

BACKGROUND OF THE INVENTION

1. Field of the Invention

The present invention relates to material handling, and in particular, to equipment and methods for facilitating removal of finished rolls after rewinding.

2. Description of Related Art

Sheet material made of paper, plastic or other materials is manufactured in a web that is wound into a relatively large roll. In many instances, this roll is too large for use in other manufacturing processes. For that reason, the web is often unwound and rewound into smaller rolls. In some cases, the web is slit into a plurality of webs that are then simultaneously wound into a number of axially shorter rolls.

A difficulty with such rewinding is the labor involved with removing finished, rewound rolls. These rolls may be relatively heavy and require special handling equipment. Also, the finished rolls may be distributed on a number of separate mandrels and special techniques are needed to remove these rolls in an orderly fashion.

In U.S. Pat. No. 4,611,769 a slitter feeds strips to one of the shafts on a turnstile. After a group of rolls is wound, the turnstile moves the shaft to an unloading position where the shaft is retracted to allow the rolls to fall onto an unloading plate. The retracted shaft is later moved with the turnstile to a loading position and redeployed to penetrate the centers of a fresh batch of empty cores. This arrangement is only satisfactory for relatively lightweight rolls that can be swung by a turnstile and later allowed to fall as a winding shaft retracts.

U.S. Pat. No. 3,845,915 shows a cantilevered shaft that is axially movable for either positioning or ejecting a roll. An ejected roll can fall "onto a hoisting device which then transports the roll out of the machine." Column 3, lines 33–34. This reference has little disclosure on the unloading of the rolls.

In U.S. Pat. No. 5,217,177 strips are wound on spindles that are mounted on a revolver. A loaded spindle can be taken off the revolver by a turret to a station where a comb can pull the rolls off the spindle while new cores are loaded from the opposite end. The spindle does not axially retract.

In U.S. Pat. No. 5,620,151 a slitter feeds a rewinder. When a complete roll is wound, a lifter rises to support the roll. After contact with the roll is detected, chucks disengage the roll, which is then lowered to a carriage that carries the roll from the machine. This reference does not disclose techniques for axially shifting the rolls.

In U.S. Pat. No. 4,346,852 a table moves between a core loading station and a station for winding and discharging rolls. When a roll is wound, holding devices are released and the rolls are lowered by receivers. Again, this reference does not disclose techniques for axially shifting the rolls.

For devices that lower a roll on swing arms, see U.S. Pat. Nos. 4,508,283; 4,749,140; 5,356,087; and 5,445,341. For a device that lowers a roll on hoisting hooks, see U.S. Pat. No. 5,121,885.

See also U.S. Pat. Nos. 4,458,853; and 5,782,425.

SUMMARY OF THE INVENTION

In accordance with the illustrative embodiments demonstrating features and advantages of the present invention, there is provided a rewinder for rewinding a web into one or more rolls on separate cores. The rewinder includes at least one rewinding mandrel having a distal end. The rewinder also has a supply means for supplying the web to the rewinding mandrel, as well as a drive means. The drive means can (a) rotate the rewinding mandrel in order to wind at least a portion of the web onto the rewinding mandrel, and (b) axially retract the mandrel to unload the portion of the web wound on the mandrel. Also included is a holder for holding the one or more rolls. The rewinder also has a lift means for (a) raising the holder to support the portion of the web wound on the mandrel, and (b) lowering the holder.

According to another aspect of the invention, a method is provided employing a holder and at least one rewinding mandrel for rewinding a web into one or more rolls on separate cores. The method includes the step of rotating the rewinding mandrel in order to wind at least a portion of the web onto the rewinding mandrel. Another step in the method is raising the holder to support the portion of the web wound on the mandrel. The method also includes the step of axially retracting the mandrel to unload the portion of the web wound on the mandrel, and lowering the holder.

By employing apparatus and techniques of the foregoing type, an improved unloading technique is achieved. In a preferred embodiment, a web is pulled from a large roll, in some cases being divided into several strips by a web slitter. This preferred embodiment has a pair of mandrels, although a different number of mandrels may be employed instead. These mandrels may grip the cores on which the web is rewound firmly without slipping, or loosely with slipping permitted. The cores can be gripped preferably with a tab that is deployed by an inflatable bladder inside the mandrel. When slipping is permitted, the cores may be kept in a desired axial position by a number of locating tabs that are deployed by another inflatable bladder inside the mandrel. The web, if slit, may be wound into a plurality of separate rolls on the mandrels. Each roll will preferably be rewound with the incoming web passing over a touch roll that touches the growing roll in order to avoid air entrapment and to stabilize the rewinding process. A retractable center support can be articulated into a central position on the mandrel to prevent sagging for embodiments with relatively long mandrels.

When a roll has been rewound on a mandrel, the preferred control system will automatically stop rotation of the mandrels and allow the operator to cut the web. The resulting loose tail of the incoming web can be caught on a preferred tail support bar that rises into position to catch this loose tail and prevent it from becoming entangled with the rolls or roll holder during an unloading sequence.

The mandrels may be rotatably mounted on a journal that rides on axially extending tracks. The journal can be moved axially by a driving belt that connects to the journal. In one embodiment, the mandrel is rotated in the journal by a series of pulleys that are driven by an engagement wheel with a number of apertures. Spring-loaded pins on a motor-driven drive wheel can engage these apertures when the journal moves into a working position.

In a preferred embodiment, an urging means can axially shift finished rolls that are rewound onto cores on the mandrels. For the lower mandrel a pressure plate is mounted on a pressing bar that axially extends to shift the finished rolls to the distal end of the mandrel. For the upper mandrel a similar pressure plate and pressing bar can be deployed but by a lesser amount. In this latter case, the mandrel can be retracted to retract the finished rolls and stack them against the upper pressure plate. An excessively high bending moment could be applied to the upper mandrel if it were retracted unsupported, with a full load of finished rolls. For this reason, a hook-like grappling means is connected to the distal end of the upper mandrel to follow and support this distal end during retraction.

A preferred holder, in the form of a platform, is supported by end rollers that act as followers that ride between vertical guides. This platform is designed to rise and support finished rolls that are rewound onto cores on the mandrels. Preferably, load sensors on the platform can detect when the platform has reached and is supporting the finished rolls.

As an example, the platform can rise to support rolls on the lower mandrel, which can then fully retract as its journal is pulled back by the above mentioned drive belt. If the above mentioned pressure plate was just operated, all of these finished rolls will be positioned for delivery to one end of the platform. Under these circumstances, the platform can then rise to the upper mandrel. Assuming the upper mandrel has retracted to bring the finished rolls against the deployed pressure plate, these finished rolls will be delivered to the opposite end of the platform as the upper mandrel fully retracts.

Once loaded, the platform can descend along the guides. The lower end of one of the vertical guides preferably diverges at a lower spur to allow a follower to retreat, so that the platform tilts. This tilting causes the finished rolls to roll off the platform. While the foregoing describes unloading both mandrels in one session, in other modes, the mandrels can be separately unloaded in two separate sessions. In still other modes a single roll can be rewound on a single mandrel (log wind).

In another embodiment, the holder platform could be detachable from the lifting mechanism and have casters that would permit transportation either manually or under power to another location for unloading.

In the preferred embodiment, the system can then go into a configuration that facilitates the loading of fresh cores. For example, with the platform in the down position, the mandrels can extend 90% to provide some clearance for loading fresh cores. In the preferred embodiment, the bearings that normally support the distal ends of the mandrels can also retract vertically to provide additional clearance for loading fresh cores.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
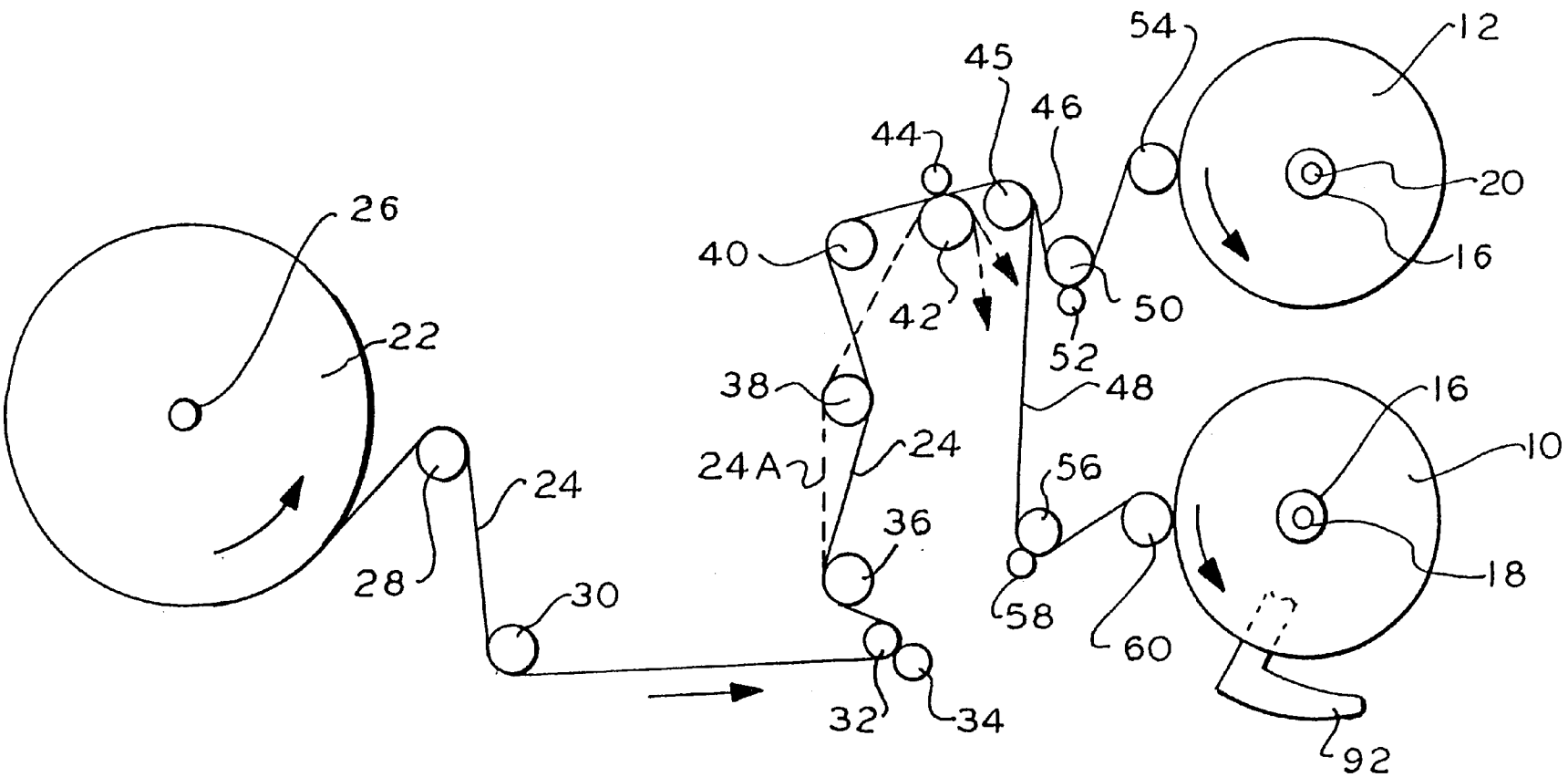
FIG. 1 is a schematic diagram of the web path from an unwinding roll to rewinding rolls in a rewinder according to principles of the present invention.

Referring to FIG. 1, a rewinder is shown rewinding rolls 10 and 12 on the cores 16, which are mounted on a first (lower) rewinding mandrel 18 and a second (upper) rewinding mandrel 20. The rolls 10 and 12 are fed by a supply roll 22, which is wound with a web 24. Supply roll 22 is mounted on a mandrel 26 (or by chucks located at both ends) that can be motor driven and/or braked so that web 24 is supplied at a predetermined tension. This tension can be controlled by a conventional feedback loop (not shown).

Web 24 is supplied over an idler roller 28 and a load cell idler 30 to a another driven roller 32 that is part of a supply means. Driven roller 32 cooperates with a nip roller 34 to deliver web 24 over idler rollers 36, 38 and 40. The web 24 need not follow the illustrated path but may be routed to different sides of the idler rollers, as suggested by the alternate course of broken line 24A.

In this embodiment, web 24 is shown routed through a slitter comprising a driven anvil (female knife) 42 cooperating with blade wheel 44 to deliver a number of slitted webs around idler roller 45. In a known manner, web 24 can be slit into a plurality of narrower webs, some routed along course 46 and others routed along course 48. Webs routed through course 46 pass around driven roller 50, which cooperates with nip bar 52. After passing around driven roller 50, the webs on course 46 pass over touch roll 54 before being wound into rolls 12. Webs routed along course 48 pass around driven roller 56, which cooperates with nip bar 58. After passing around driven roller 56, the webs on course 48 pass over touch roll 60 before being wound into rolls 10. Bars 52 and 58 are round bars that do not rotate. They nip against rollers 50 and 56 to clamp web tails during the subsequently described unload sequence. This helps maintain tension on webs leading back to the knives.

Referring to FIGS. 1–4, the previously mentioned rolls 10 are shown as five separate rolls 10A through 10E mounted on mandrel 18. Previously mentioned rolls 12 are shown as four separate rolls 12A through 12D mounted on mandrel 20. Mandrels 18 and 20 are shown with gripping means in the form of gripping tabs 84 and 86, respectively. Gripping tabs 84 and 86 are axially repositionable in a longitudinal track in the mandrels over an internal strip (not shown) that can be outwardly driven by an inflatable bladder (not shown) inside the mandrels. Axially repositionable locating tabs 88 and 90 are shown mounted on mandrels 18 and 20, respectively, at angular positions that are different than that of tabs 84 and 86. Locating tabs 88 and 90 are axially repositionable in a longitudinal track in the mandrels over an internal strip (not shown) that can be outwardly driven by an inflatable bladder (not shown) inside the mandrels. The inflatable bladders that drive tabs 84 and 88 are located at angularly spaced positions inside mandrel 18. Likewise, the inflatable bladders that drive tabs 86 and 90 are located at angularly spaced positions inside mandrel 20.

Figure 3:
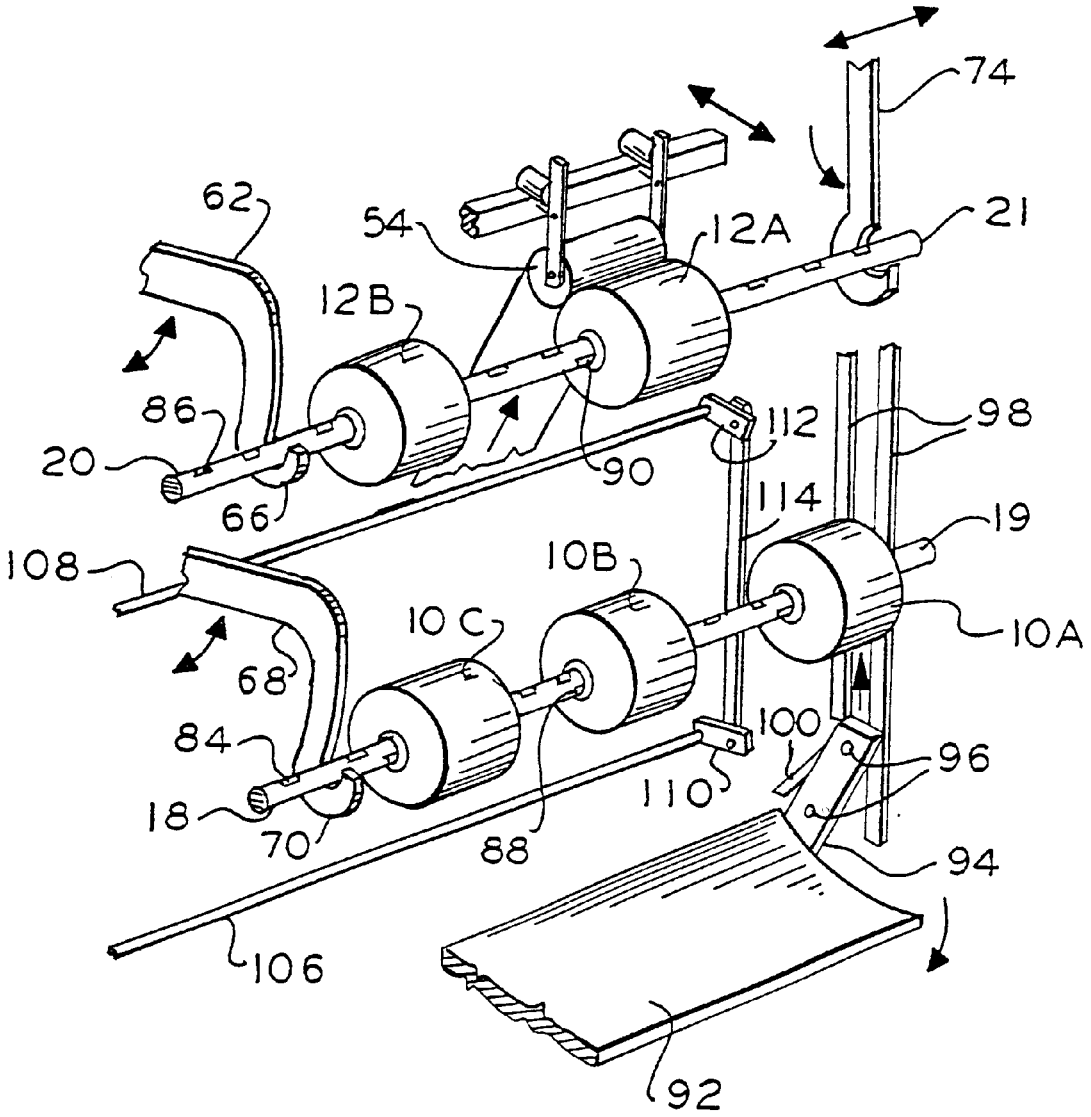
FIG. 3 is a detailed axonometric view of a portion of the rewinder of FIG. 2 near the distal end of the mandrels.

A retractable center support is shown as an arm 62 mounted on shaft 64. Arm 62 has a hooked distal end 66 for centrally supporting the underside of second mandrel 20. Arm 62 can be rotated through a pneumatically actuated lever arm 65, schematically illustrated in FIG. 4. A rotatably mounted retractable center support 68 is shown with a hooked end 70 centrally supporting first mandrel 18 (FIG. 3). Support 68 is rotatably supported on a shaft, illustrated schematically in FIG. 4 as shaft 72. Shaft 72 is rotated by lever arm 73, which is schematically shown linked to the drive arm 67 on shaft 64. Thus linked, rotation of pneumatically operated arm 65 simultaneously rotates linked arms 67 and 73 to likewise rotate support arms 62 and 68. In the preferred embodiment, once the center supports are in place a hydraulic ram (not shown) is advanced to mechanically latch the center supports in place.

Figure 2:
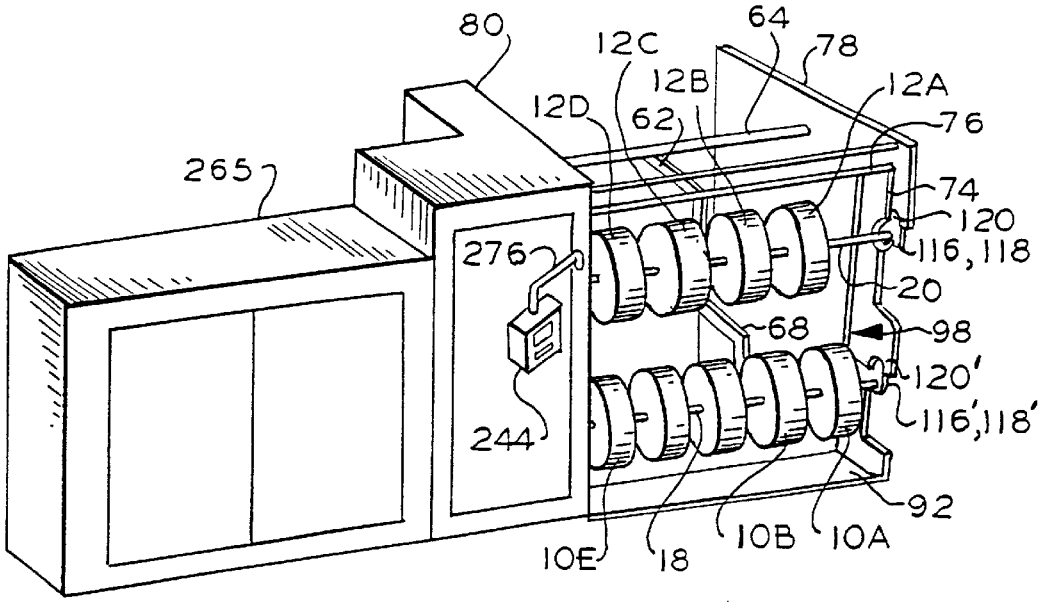
FIG. 2 is an axonometric view of the rewinder of FIG. 1.

The distal end 21 of mandrel 20 is shown in FIG. 3 supported by a swinging hook 74, referred to herein as a grappling means. As described further hereinafter, swinging hook 74 can support and follow the distal end 21 of mandrel 20 as it retracts with a load of rolls, such as rolls 12A–12D. The distal end 19 of mandrel 18 does not have such a grappling means in this embodiment, although both mandrels could be supplied with grappling means in alternate embodiments. Swinging hook 74 is shown mounted on a carrier 76 (FIG. 2). In this embodiment, hook 74 has on its upper end a linear bearing (not shown) that rides on a track on carrier 76. Carrier 76 is rotatably mounted between side frame 78 and frame assembly 80. Carrier 76 can be rotated pneumatically using the lever arm 82 illustrated schematically in FIG. 4.

Frame assembly 80 supports among other things, mandrels 18 and 20 and is adjacent to a cabinet 265 housing equipment for rotating and retracting/extending the mandrels, etc.

A pair of horizontal bars 106 and 108, herein referred to as tail supports, are mounted between two pairs of support brackets 110 and 112, respectively. The brackets 110 and 112 are mounted on opposite ends of carrying rods 114. Two identical carrying rods 114 are mounted near frame 78 and frame assembly 80. Each of the carrying rods 114 can be lifted by an air cylinder (not shown) to lift the support rods 106 and 108.

Referring to FIGS. 2, 3, 4, and 11, a holder, shown as platform 92, is supported at either end by upright struts 94. Struts 94 are located off-center and support a pair of followers 96 in the form of a pair of wheels that ride between the vertical guides 98. The inner one of the guides 98 has a lower spur 100 that diverges outwardly to increase the spacing between the guides. Accordingly, platform 92 is kept relatively level when the followers 96 are riding between the upper portions of guides 98. However, the lower one of the followers 96 will occasionally reach the lower spur 100 and swing backwardly to allow tilting of platform 92. Platform 92 is lifted by a chain 102, which is part of a lift means. Chain 102 rides over a pulley 104 and may terminate in a counter weight (not shown). Chain 102 can be driven by a pneumatic cylinder attached to the end of the chain. Alternatively, pulley 104 can be rotated by an electric motor (not shown).

In one embodiment the holder platform can employ a platform that is elevated by a scissor-like structure having a pair of pivotally connected members. In another embodiment, the holder platform could be detachable from the lifting mechanism and have casters (not shown) that would permit transportation either manually or under power to another location for unloading.

Figure 5:
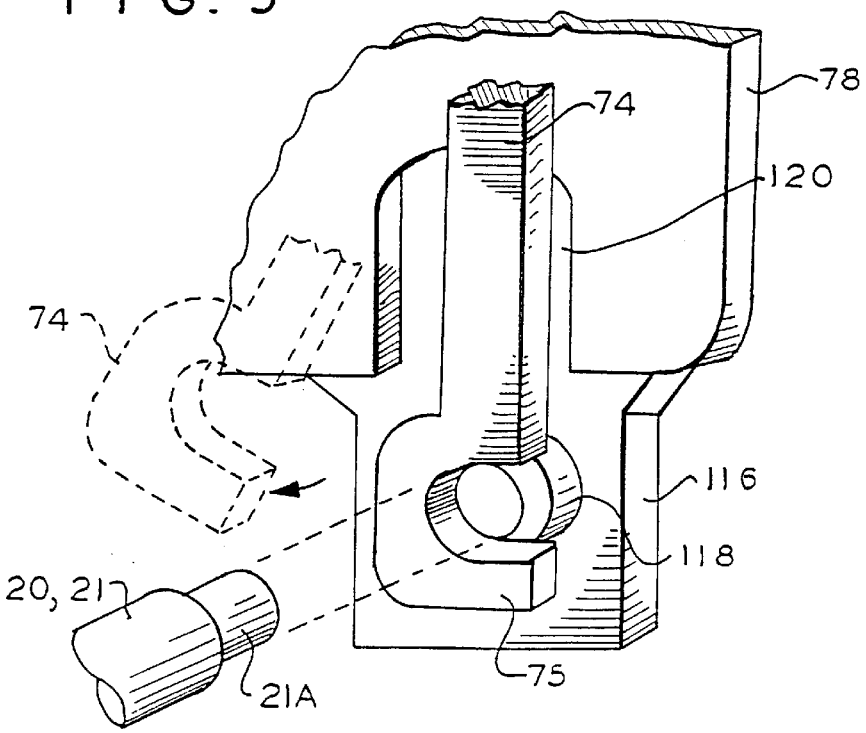
FIG. 5 is a detailed axonometric view of the upper, retractable end support of FIG. 2 and its relationship to its mandrel and the grappling means.

Referring to FIGS. 2 and 5, previously mentioned side frame 78 is shown supporting a slide plate 116. Previously mentioned grappling means 74 is shown in a working position adjacent to side plate 116. Grappling means 74 can also retract by swinging backwardly as illustrated by the phantom position. In the working position, hooked lower end 75 can engage the distal end 21 of mandrel 20. (For clarity, mandrel 20 is shown retracted from the hooked end 75 of grappling means 74, although normally mandrel 20 will be deployed inside the hooked end 75 whenever it descends to the illustrated working position.)

A collar-like journal 118 (also referred to as a chuck) is shown centrally mounted on a lower portion of the plate 116 for rotatably supporting the reduced diameter portion 21 A of distal end 21 of mandrel 20. As described in further detail hereinafter, mandrel 20 can alternately extend into, and retract from, journal 118. Also, after retraction of the mandrel, plate 116 can be pneumatically lifted upwardly into the notch 120 in side frame 78. Accordingly, plate 116 and journal 118 can act as a retractable end support. In FIG. 2 a similar slide plate 116' is shown acting as a retractable end support for mandrel 18. As before, a notch 120' in side frame 78 allows clearance when slide plate retracts upwardly.

Figure 6:
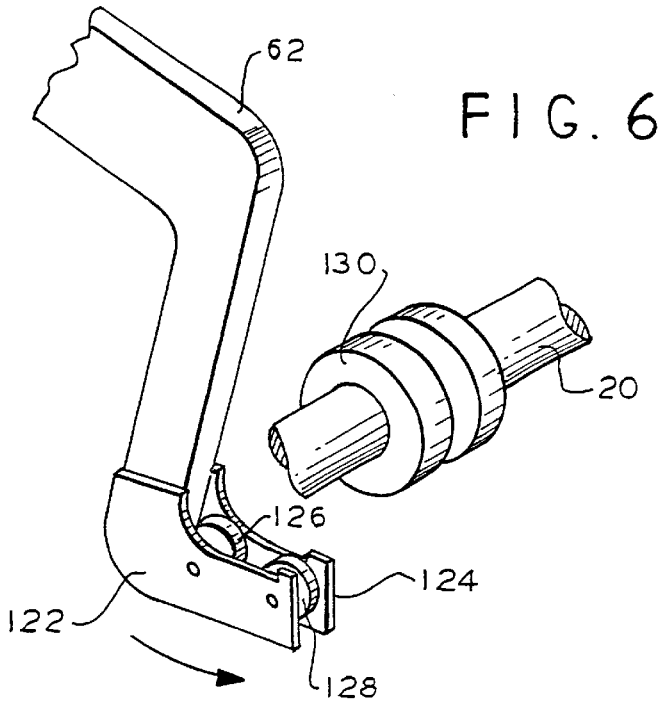
FIG. 6 is an axonometric viewing of a portion of one of the retractable center supports of FIG. 3 about to engage its mandrel.

Referring to FIG. 6, previously mentioned support arm 62 is shown about to swing into position under mandrel 20. It will be appreciated that the description of this figure will likewise apply to previously mentioned support arm 68 (FIG. 3). A pair of side plates 122 and 124 are attached to opposite sides of the distal end of support arm 62. Rotatably mounted between plates 122 and 124 are a pair a rotatably supported wheels 126 and 128. Wheels 126 and 128 project slightly above the upper edges of plates 122 and 124. A circumferentially grooved collar 130 is releasably clamped to mandrel 20, so that wheels 126 and 128 can ride in the groove of collar 130.

Figure 7:
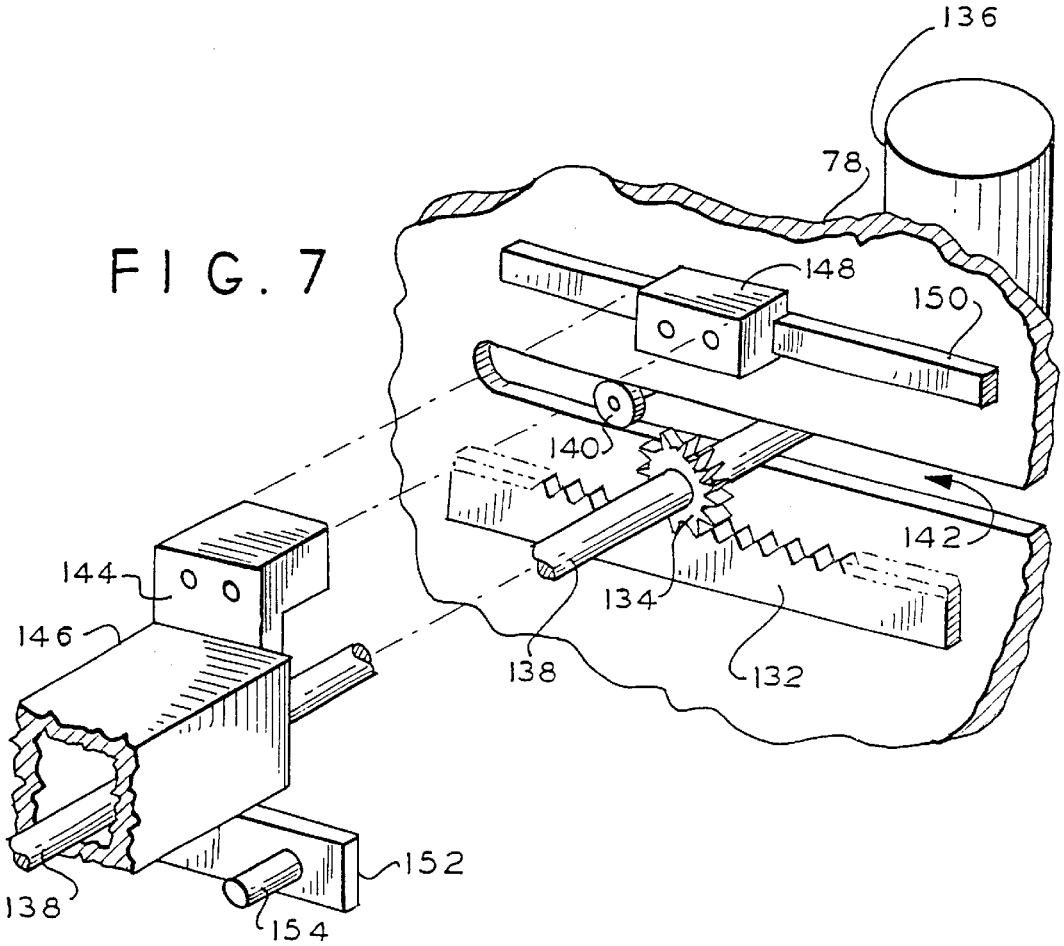
FIG. 7 is an exploded, axonometric view of the mechanism supporting the carriage that carries the touch roll of FIG. 3.
Figures 8, 9:
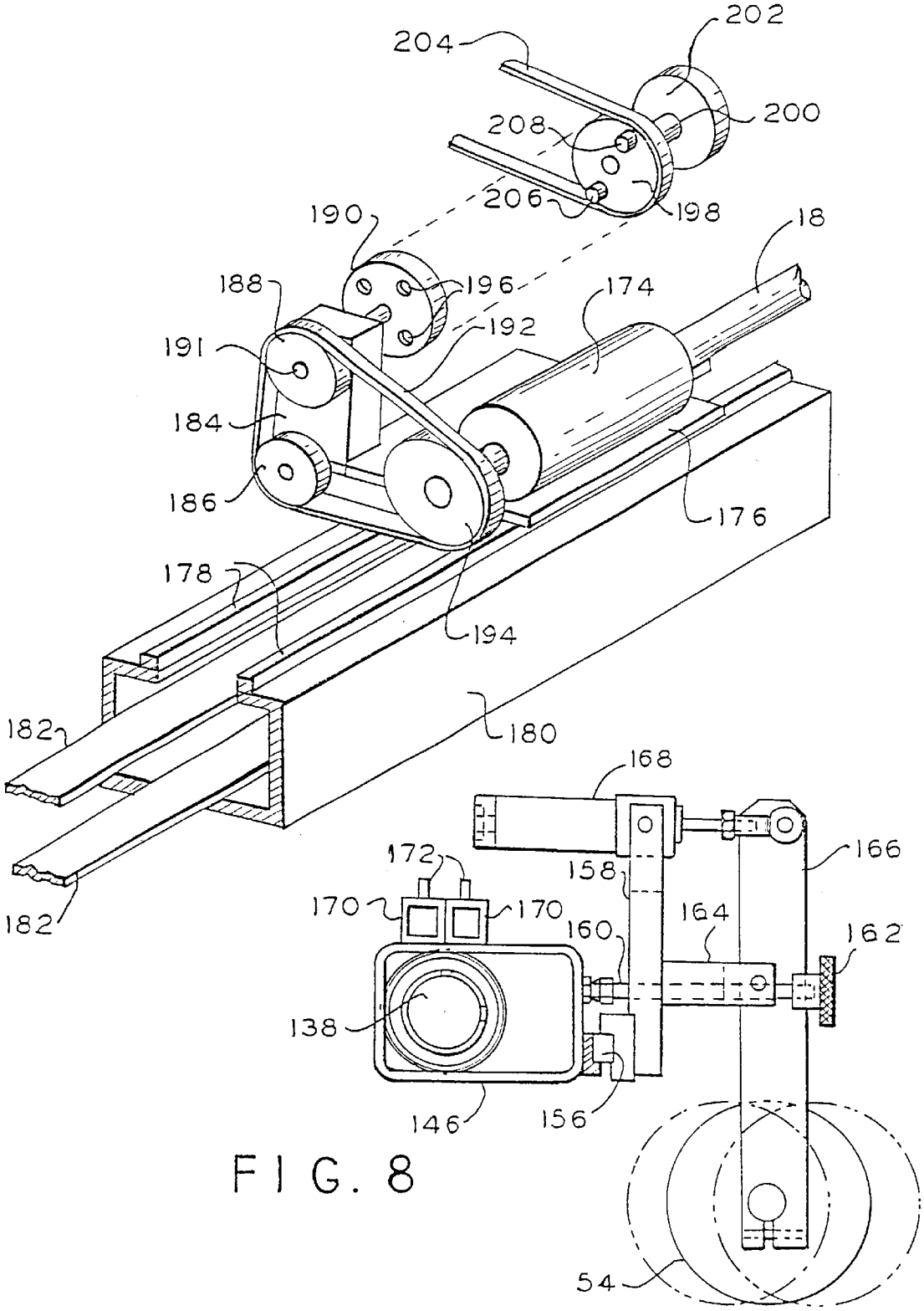
FIG. 8 is a cross-sectional view of the touch roll and supporting beam of FIGS. 3 and 7.
FIG. 9 is an axonometric view of axially extending tracks carrying a journal for one of the mandrels of FIG. 2, which is driven by a drive means.

Referring to FIGS. 7 and 8, a rack 132 is shown attached to the inside face of side frame 78. It will be appreciated that the structure shown in this figure will be replicated on the opposing inside face of frame assembly 80 (FIG. 2). A pinion 134 is shown driven by a motor 136 by means of drive shaft 138. Motor 136 is supported by shaft 138, but is prevented from rotating by a follower wheel 140 attached to the motor and riding in slot 142. Shaft 138 is journaled in bracket 144, which is attached between hollow beam 146 and linear bearing 148. The bearing 148 rides on track 150 mounted on the inside face of side frame 78. The bracket 152 attached to the underside of beam 146 supports a photodetector 154, which controls retraction of the beam 146, in response to growth of the previously mentioned rewinding roll, in a manner to be described hereinafter.

A linear bearing 156 attached to the forward face of beam 146 supports a laterally adjustable bracket 158, which can be locked in place by turning handle 162 to tighten the threaded shaft 160. A standard 164 attached to bracket 158 pivotally supports a pair of levers 166, which rotatably support touch roll 54 (or in another location touch roll 60). The upper end of bracket 158 supports a pneumatic cylinder 168 that can be operated to swing the levers 166. A pair of pressure channels 170 are mounted atop beam 146. Channels 170 have a number of fittings 172 that can be used to provide pneumatic pressure to cylinder 168 at the various positions where it may be located along the beam 146.

Figure 10:
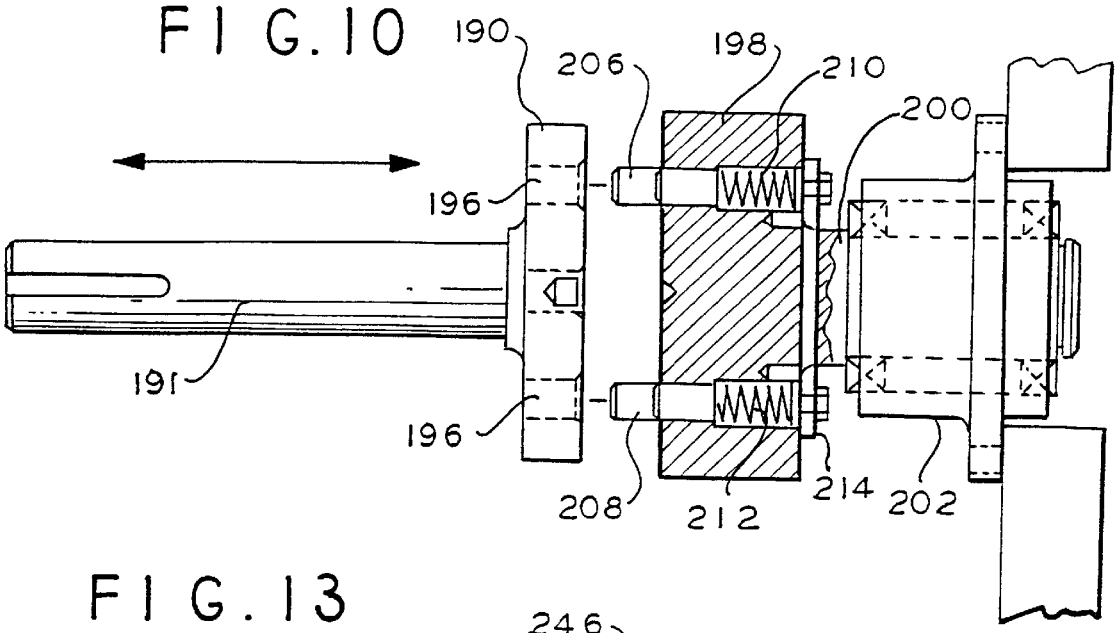
FIG. 10 is a side view, partially in section, of a portion of the drive means of FIG. 9.

Referring to FIGS. 9 and 10, mandrel 18 is shown connected to a drive means including a journal 174, which is a relatively long bearing supported on a platform 176. Platform 176 includes a linear bearing (hereinafter shown) that rides on the axially extending tracks 178 mounted along the longitudinal opening in C-shaped beam 180. A motor-driven belt 182 connects to platform 176 to move journal 174 along tracks 178. A bearing block 184 mounted in one corner of platform 176 rotatably supports pulleys 186 and 188. An engagement means is shown as a wheel 190 with four equiangularly spaced apertures 196. Wheel 190 is mounted on a common shaft 191 with pulley 188 to drive that pulley. Pulley 188 drives a belt 192 that circulates over idler pulley 186 and a driven pulley 194, which is coaxially connected to mandrel 18 in order to drive it.

An axially stationary drive pulley 198 (also referred to as a rotor) is mounted on a common shaft 200, rotatably supported on bearing housing 202, to be rotated by a motor-driven belt 204. Pulley 198 has a pair of axial bores fitted with spring loaded pins 206 and 208 located at diametrically opposite positions. Pins 206 and 208 have inside flanges that keep the pins trapped inside the bores in pulley 198. These bores contain springs 210 and 212, which are trapped between backer plate 214 and pins 206 and 208, respectively. Arranged in this fashion, wheel 190 can move against pins 206 and 208, which can retract. As rotor 198 turns, eventually pins 206 and 208 reach the apertures 196 and snap into these apertures so that pulley 198 can drive the wheel 190.

In other embodiments the motor for driving the mandrel can move axially with the mandrel, in which case the foregoing engagement means is unnecessary.

Figure 12:
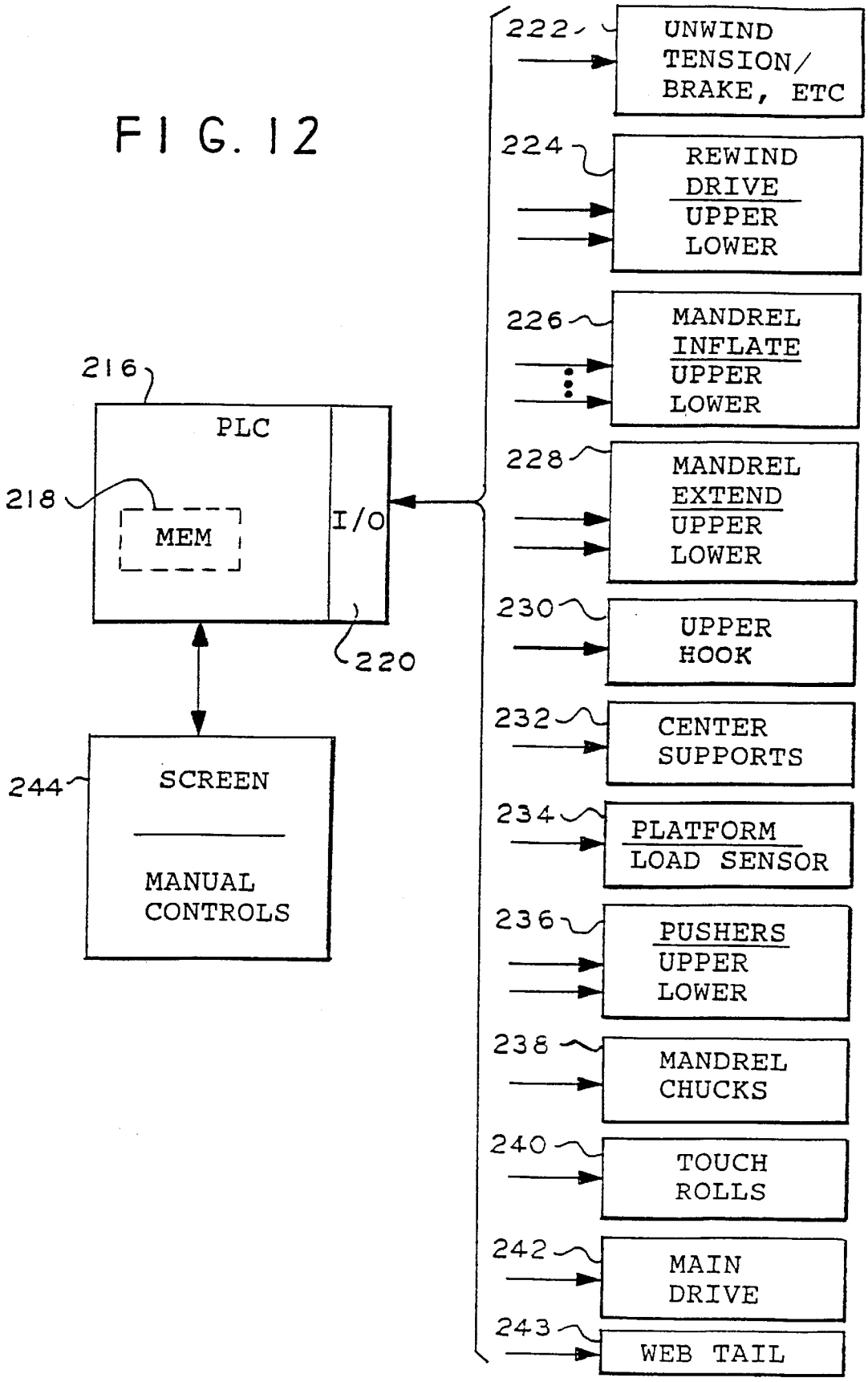
FIG. 12 is a schematic diagram of a control means connecting to various pieces of equipment associated with the rewinder of FIG. 2.

Referring to FIG. 12, a control means is shown herein as a programmable logic controller 216 (also referred to as a digital processor means). Controller 216 is a digital computer having a memory 218 and an input/output section 220. Input/output section 220 has drive circuits connecting to blocks 222–243 in order to operate relays and other equipment needed to control the foregoing rewinder. Block 222 has an output for controlling the supply roll 22 (FIG. 1). The unwinding supply roll 22 can have a drive motor and/or brake to regulate the web delivery. This subsystem can also have a sensor (not shown) for measuring web tension to produce a feedback signal to control the above mentioned motor and/or brake.

Figure 4:
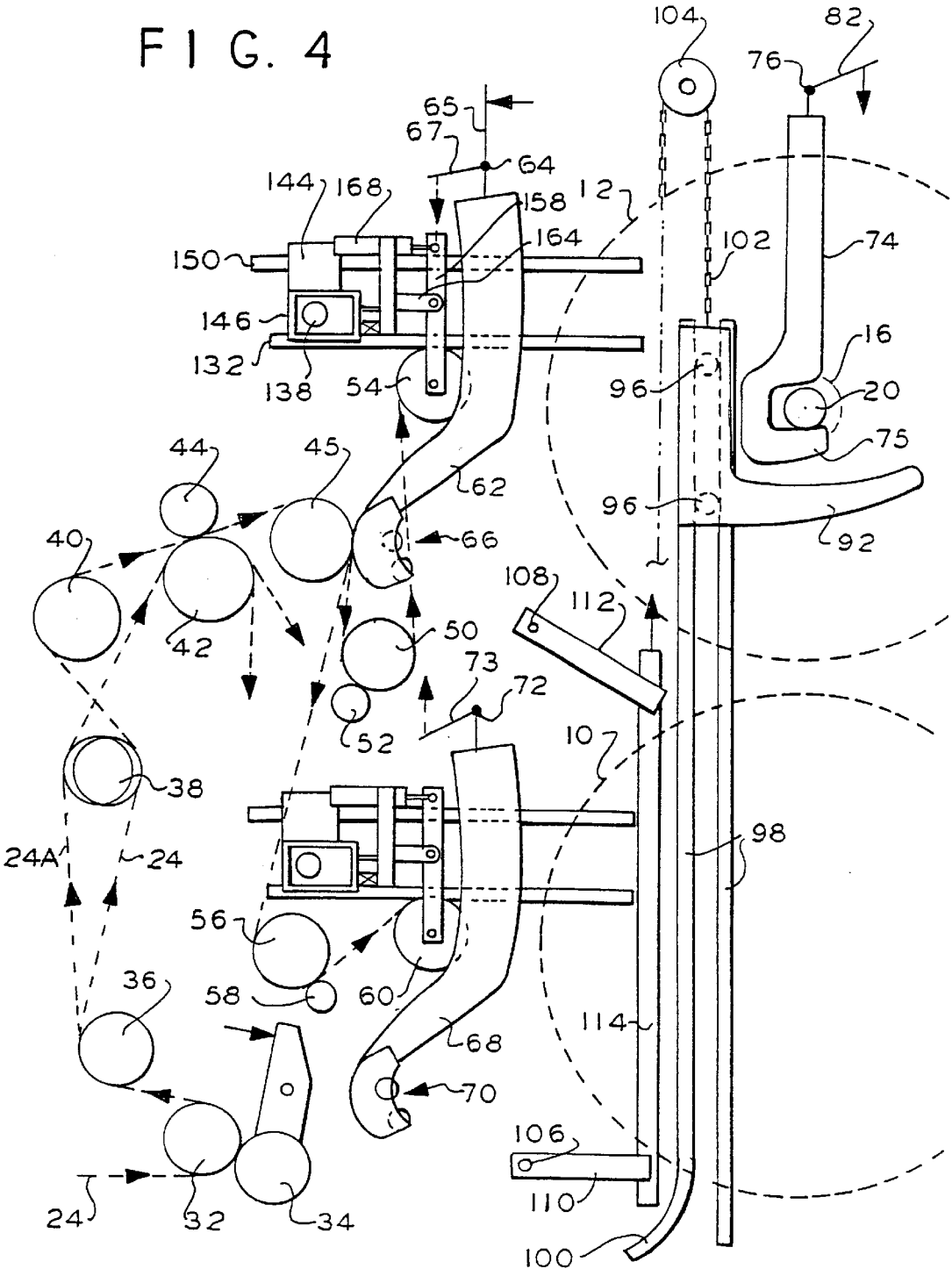
FIG. 4 is a detailed schematic diagram of a portion of the web path of FIG. 1 near the mandrels.

Block 224 has two outputs for controlling the drive to the motors that rotate the upper and lower mandrels 18 and 20 (see FIG. 9). Block 226 has outputs for controlling inflation of the bladders inside mandrels 18 and 20. Specifically, this block can control the gripping tabs 84 and 86, as well as the locating tabs 88 and 90 (FIG. 3). Block 228 can control the extension and retraction of mandrels 18 and 20 by operating the motor-driven belt 182 (FIG. 9). Block 230 can control the articulation of hook 74 by operating the pneumatic cylinder that controls lever arm 82 (FIG. 4). Block 232 can articulate the arms 62 and 68 by operating the pneumatic cylinder that rotates lever 65 (FIG. 4).

Block 234 can operate platform 92 by circulating chain 102 (FIG. 4). Block 234 can also receive input signals that sense the weight of rolls being supported on the platform 92. In the preferred embodiment, two pressure sensitive mats are placed at opposite ends of the platform to act as load sensors for detecting weight on either the left or right end of the platform, in order to produce a corresponding weight signal.

Block 236 controls pushers that will be described presently. Block 238 can control both of the retractable end supports, such as the one shown in FIG. 5. Block 240 can control the touch rolls 54 and 60. Specifically, block 240 can control the pressure applied to cylinder 168 (FIG. 8) and the position of beam 146 carrying the touch rolls by operating motor 136 (FIG. 7). As described further hereinafter, motor 136 can be controlled by the positioning signals received from photo-detector 154. Block 242 can operate the motors of the supply means that supplies the web. Block 243 can operate the web tail puller 106 and 108 (FIG. 3).

Figure 13:
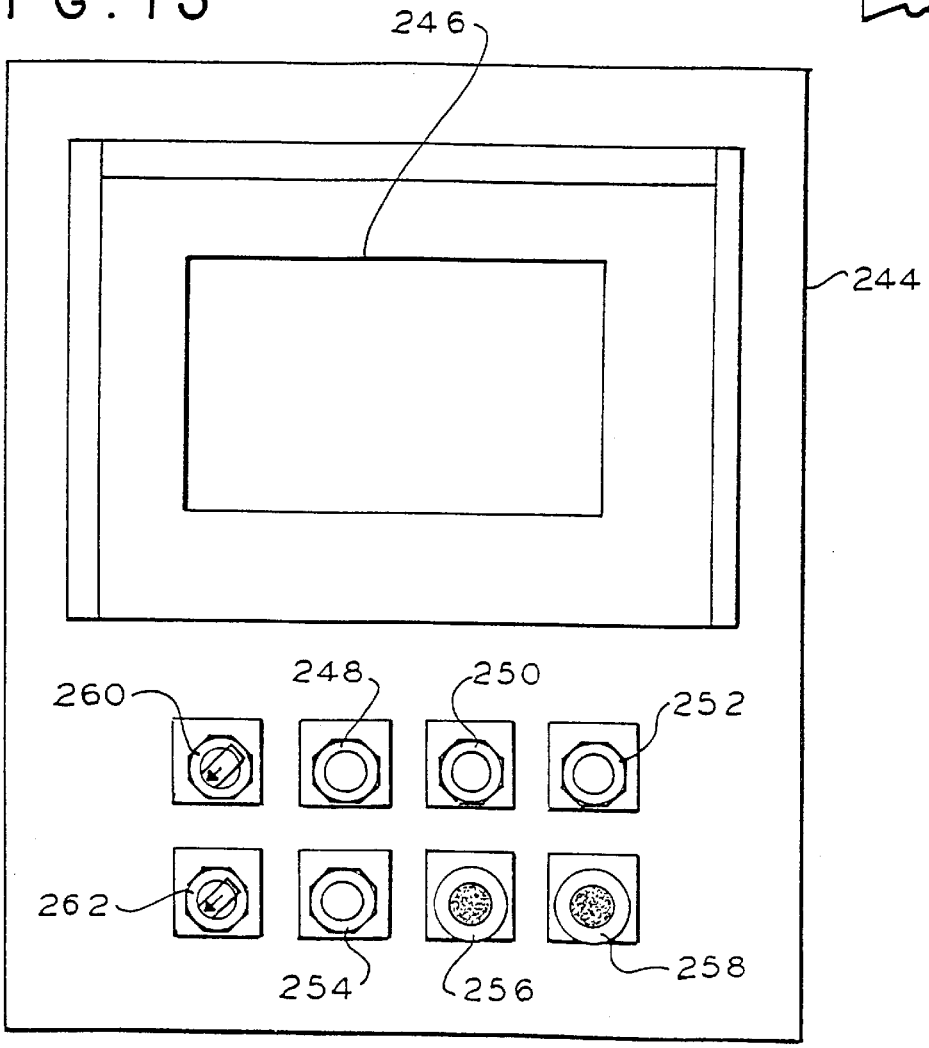
FIG. 13 is a front view of the manually operable input device of FIG. 12, showing a touch screen and a number of other manual controls.
Figure 11:
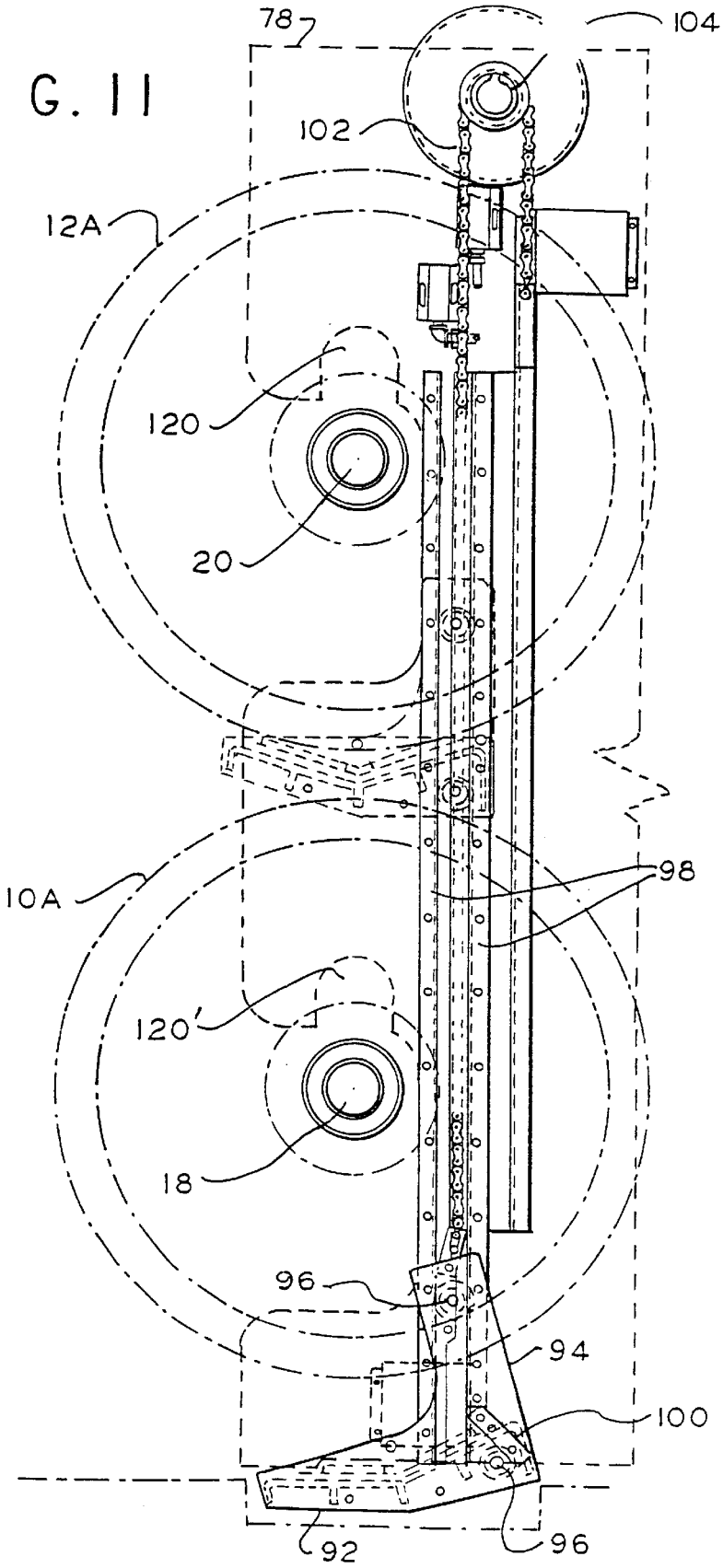
FIG. 11 is an end view of the rewinder of FIG. 2 with its side frame shown in phantom.

FIGS. 12 and 13 show a manually operable input device 244 having a touch screen 246. Screen 246 is an LCD display that can produce an image of a virtual pushbutton. Screen 246 is touch-sensitive so that the displayed buttons can actually be "pressed" in the sense that the computer 216 attached to device 244 can sense tactile pressure on the screen at a determinable position. Buttons 248–258 are conventional pushbuttons that are labeled to indicate the following functions: Run, Jog, Emergency Stop Reset, Machine Stop, Unload Sequence Stop, and Emergency Stop. The nature of these functions will be described further hereinafter.

Knob 260 is designed for adjusting the web speed. The angular position of knob 260 can be detected by the previously mentioned computer 216 and can be taken as an operator command to establish web speed at a desired magnitude. Knob 262 is designed for adjusting the unwind tension from the supply roll 22 (FIG. 1). The angular position of knob 262 can be detected by the previously mentioned computer and can be taken as an operator command to establish web tension at the supply roll 22. Device 244 is shown in FIG. 2 as a case mounted on support rod 276.

Referring to FIGS. 14A through 14F, previously mentioned mandrel 18 is shown rotatably mounted in journal 174, which is supported on the platform 176 that rides on the linear bearings 177 on track 178 of beam 180. In a similar fashion, mandrel 20 is shown rotatably mounted in journal 174', which is supported on the platform 176' that rides on the linear bearings 177' on track 178' of beam 180'. Mandrels 18 and 20 are shown with their distal ends 19 and 21 supported in chucks 118' and 118 (also referred to as retractable end supports).

A first urging means is shown as pusher plate 268 mounted on one end of threaded rod 266. Rod 266 is threadably supported in the motor-driven, threaded collar 264 to act as a lead screw. Accordingly, rotation of collar 264 will cause pusher plate 268 to extend and retract. A second urging means is shown with a pusher plate 274 mounted on one end of guide rod 272. Rod 272 is axially movably mounted in collar 270. Pneumatic actuation will cause pusher plate 274 to extend and retract.

Figure 16A:
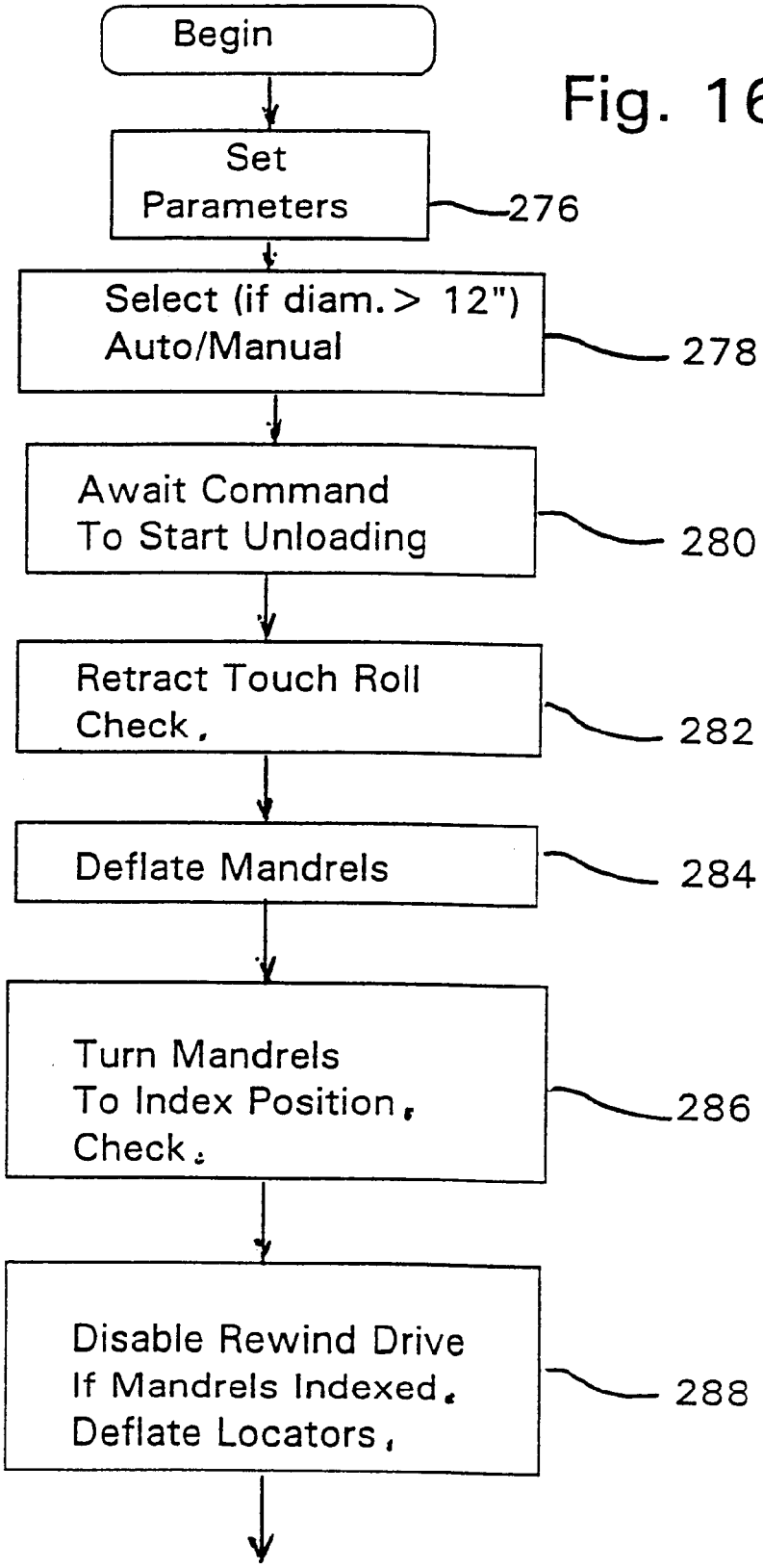
FIGS. 16A through 16D are flow charts illustrating operations associated with the control means of FIG. 14.

To facilitate an understanding of the principles associated with the foregoing apparatus, its operation will be briefly described. Referring to the flow chart of FIG. 16A, an operator may set various parameters at step 276 using touch screen 246 (FIG. 13). In addition, the operator can save all of these parameters to memory 218 of control means 216 (FIG. 12) for later recall.

In this manner, the operator may enter the thickness and density of the web, as well as the desired tension in the web as it unwinds from the supply roll 22 (FIG. 1). The operator may also enter the number and the width of the rolls that are to be rewound on the mandrels 18 and 20. The operator may also enter the diameter of the cores 16, as well as the desired outside diameter of the finished rolls 10 and 12 on the mandrels 18 and 20. As an alternate target for ending the rewinding process, the operator can also enter the desired length of web to be rewound. The operator may also enter a web length adjustment factor for initial calibration of the length measurement means.

Since the desired tension in the web preferably varies during the process, the operator can enter the desired web tension for the beginning and end of the rewinding process. The operator may also enter the desired pressure to be applied by the touch rolls 54 and 60 (FIGS. 3 and 4). In some embodiments, the touch rolls can be pressured by different size pneumatic cylinders. For this reason, the operator can enter the size of the installed pneumatic cylinders to allow accurate adjustment of the pressure of the touch rolls 54 and 60. Also, in some cases the pressure applied by the touch rolls 54 and 60 ought to vary dynamically. For this reason, the operator may enter a compensation value that will increase the pressure of the touch rolls as speed increases. It has also been found that the pressure of the touch rolls may need to be increased as the rewinding package increases in diameter. Accordingly, the operator can enter a compensation value that provides the desired amount of increase.

In some cases it is desirable to allow the mandrels 18 and 20 to slip inside cores 16 by running the mandrels at a speed in excess of that needed to produce the desired web speed. The operator can specify this overspeed or slip speed by entering (1) a desired slip speed in rpm, or (2) a percentage overspeed value based on the speed needed to produce the desired web speed.

While the torque applied to the mandrels 18 and 20 might normally determine the tension of the web being rewound onto the mandrels, various mechanical losses may affect this value. For this reason, the operator may enter a friction compensation value that allows more precise control of tension.

The operator may also enter the time permitted for accelerating and decelerating mandrels 18 and 20. Additionally, the operator can enter the speed at which the machine will advance when the operator depresses the jog control button 250.

In step 278 (FIG. 16A) the operator can indicate through touch screen 246 how rolls will be removed from mandrels 18 and 20. In this example, the operator will select manual unloading of both mandrels together, which is also referred to herein as the manual shared mode. In the manual mode, the operator is prompted to initiate each subsequent action in the unloading process. In addition, a fully automatic mode exists which steps through the entire cycle while only prompting operator actions that are manually performed within the overall sequence such as cut-off and core loading operations. Automatic removal will only be allowed if the diameter of the rewound rolls exceeds 12 inches (30.5 cm). In other cases, the two mandrels can be unloaded in separate stages, if desired. In still other cases, only one mandrel will be rewinding and will contain a single roll (log roll mode).

In step 280 the operator can press a virtual "start" button displayed on touch screen 246 to begin the unloading sequence, assuming the rolls have been fully rewound to the target dimension. In succeeding step 282, computer 216 will send a signal through block 240 (FIG. 12) to the actuators for the touch rolls 54 and 60 (FIG. 4). Specifically, pneumatic cylinders 168 (FIG. 8) will be activated to withdraw the touch rolls, while electric motor 136 (FIG. 7) will be activated to withdraw the beam 146 carrying the touch rolls. The system will also verify execution of the desired action by monitoring changes in the signals in any feedback loop associated with the touch rolls.

Next in step 284, computer 216 will send a signal through block 226 to retract the tabs 84, 86, 88, and 90. In the following step 286, block 224 will cause mandrels 18 and 20 to rotate at 5 rpm to bring the gripping tabs 84 and 86 to a 6 o'clock (down) position, as sensed by position sensors (not shown), in order to maximize the clearance between the cores 16 and the mandrels. Again, the system will also verify execution of the desired action by monitoring these position sensors. Once the mandrels 18 and 20 have been properly positioned, the drive to the mandrels is disabled in step 288.

Figure 16B:
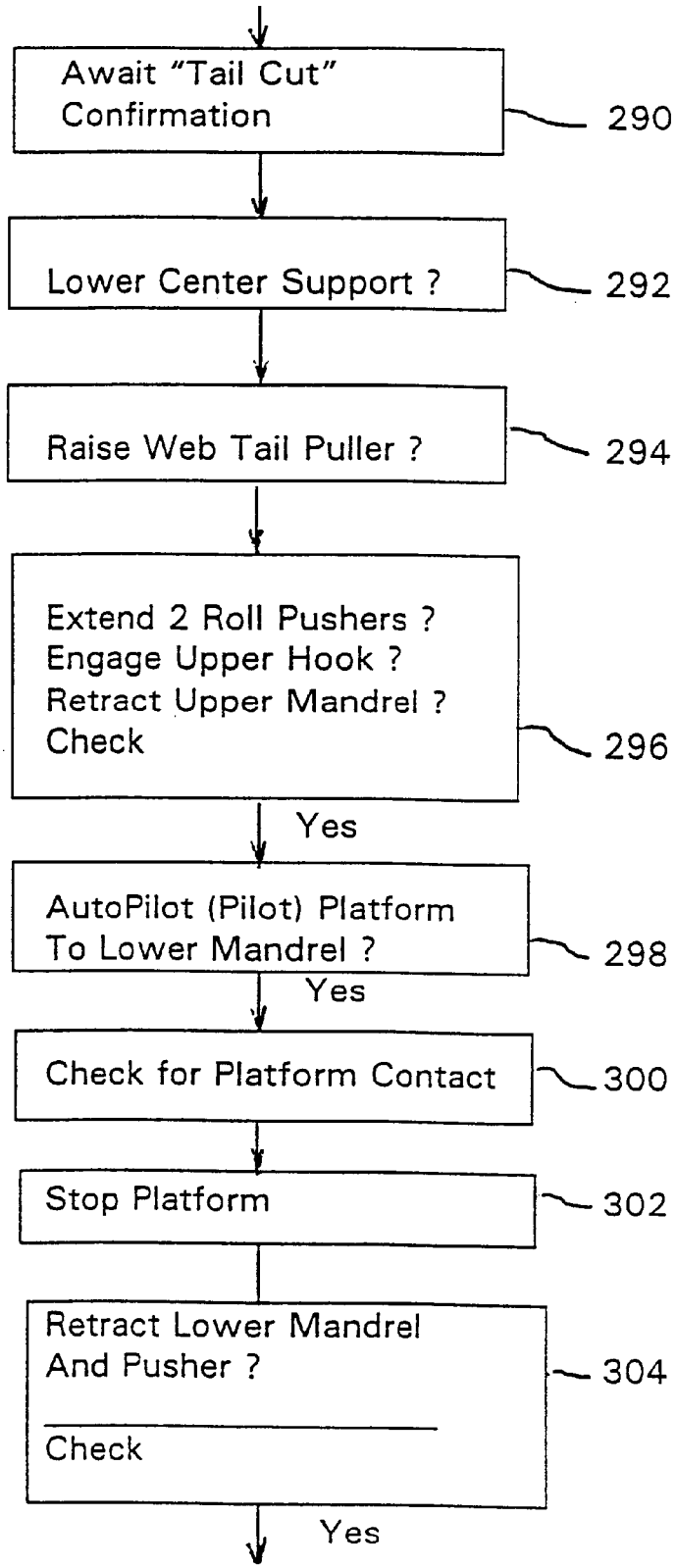

In step 290 (FIG. 16B) computer 216 will display on screen 246 the message "Operator to Cut Tails." In response, the operator must now cut the web near the rolls on mandrels 18 and 20, thereby producing relatively short tails from these rolls. Once these tails are cut, the operator can signal completion of this cutting operation by depressing a virtual, flashing pushbutton displayed on touch screen 246 and labeled "Operator Procedure Completed." Thereafter in step 292, the operator will be presented with a flashing, virtual pushbutton labeled "Center Supports Lower." Upon pressing this virtual pushbutton, computer 216, operating through block 232, will operate the associated pneumatic cylinder to rotate lever 65 and retract arms 62 and 68 (FIG. 4). Thereafter in step 294 the operator will be presented with a flashing, virtual pushbutton labeled "Raise Rewind Web Tail Puller." Upon pressing this virtual pushbutton (in the automatic mode the process proceeds without requesting or awaiting a manual signal from an operator), computer 216, operating through block 243, will operate the associated pneumatic cylinder to lift web tail puller bars 106 and 108 (FIG. 3). Bars 106 and 108 will hold the ends of the incoming web so they do not fall into the path of the rolls during unloading and become tangled.

Next in step 296 a flashing, virtual pushbutton labeled "Roll Pushers Extend" can be pressed. When this pushbutton is pressed (in the automatic mode the process proceeds without requesting or awaiting a manual signal from an operator), computer 216, operating through block 236 will operate the lead screw mechanism 264 and pneumatic actuator 270, which in other embodiments could be a lead screw mechanism. Pusher plate 268 will extend to move the rolls 10A–10E from the position shown in FIG. 14A to the right position shown in FIG. 14B. Pusher plate 268 will extend to a calculated position. The actual position of pusher plate 268 is continually measured and fed back to computer 216 by a position sensor (not shown) associated with pusher plate 268. Note that pusher plate 274 will also be extended at this time, but without further effect. Computer 216 will now display a virtual, flashing pushbutton labeled "Upper Hooker Engage." When this pushbutton is pressed (in the automatic mode the process proceeds without requesting or awaiting a manual signal from an operator), computer 216, operating through block 230, will rotate pneumatically operated lever 82 (FIG. 4) to swing hook 74 onto the distal end 21 of mandrel 20.

Figure 14A:
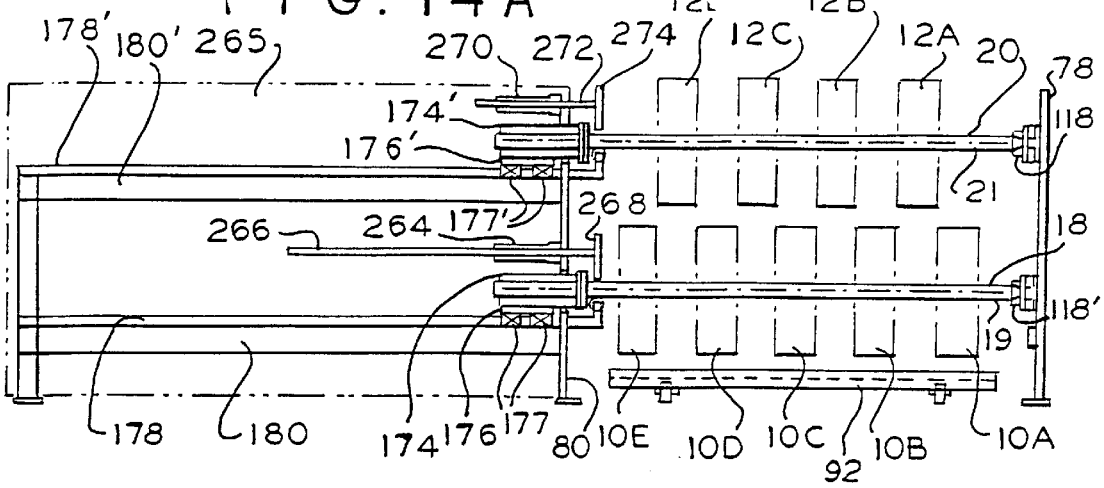
FIGS. 14A through 14F show a sequence of operations being performed by the rewinder of FIG. 2 in an automatic shared mode.
Figure 14B:
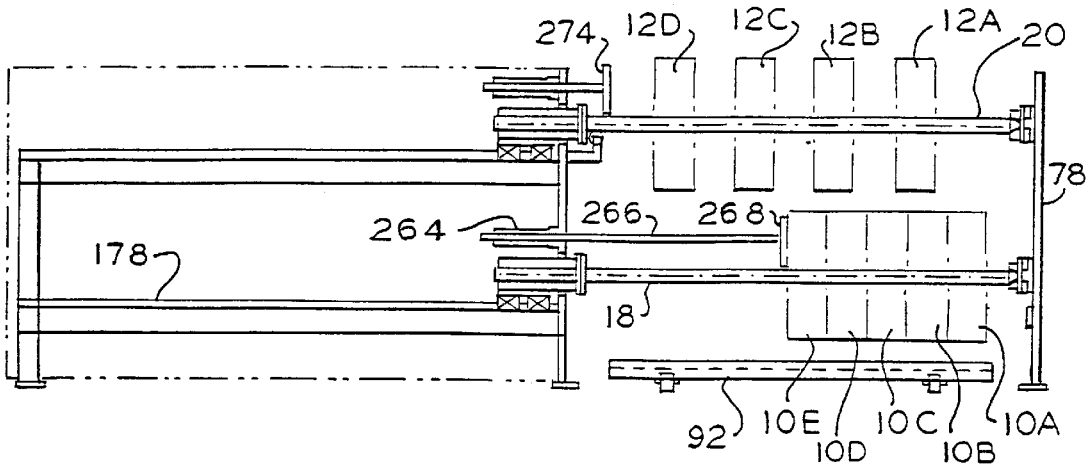
Figure 14C:
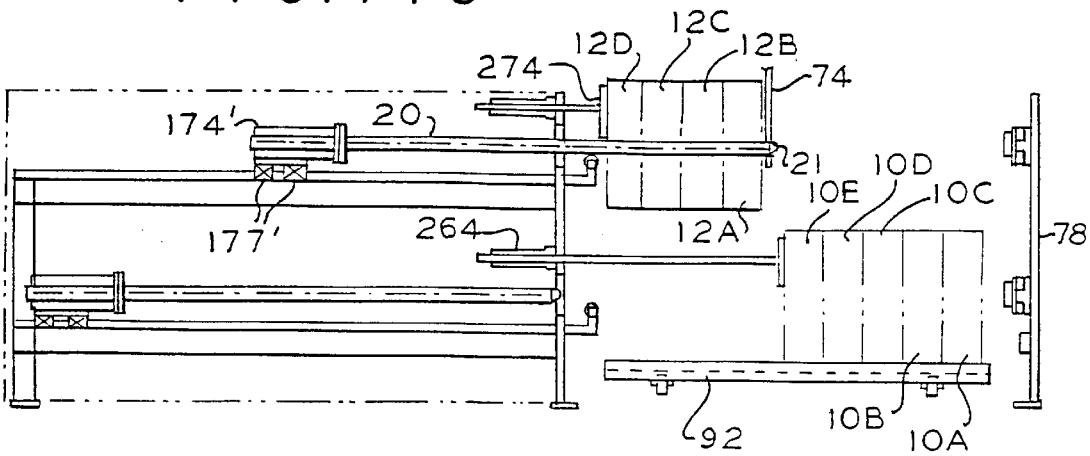
Figure 14D:
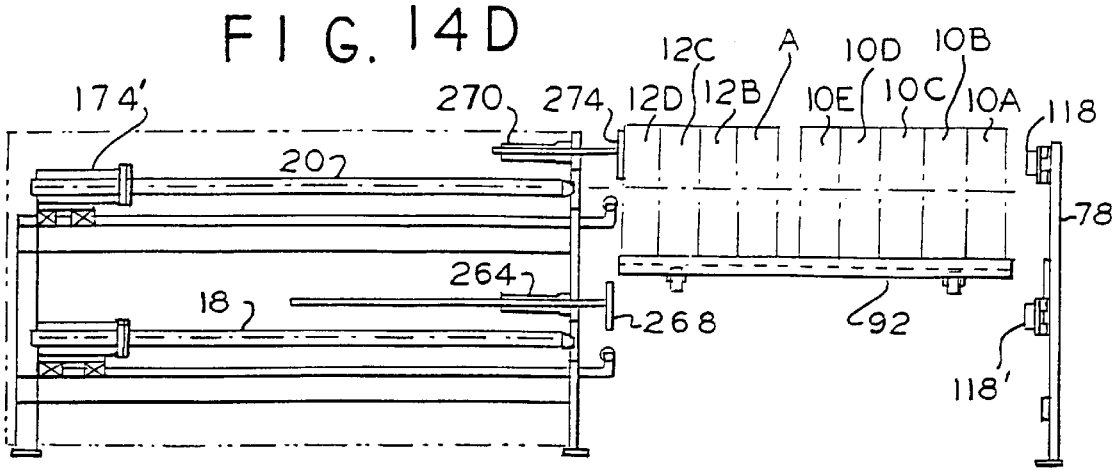

Computer 216 will now display a virtual pushbutton on touch screen 246 labeled "Upper Mandrel Retract." When this pushbutton is pressed (in the automatic mode the process proceeds without requesting or awaiting a manual signal from an operator), computer 216, operating through block 228, will retract journal 174' as shown in FIG. 14C. Journal 174' will ride on linear bearings 177' under the control of a driving belt, similar to driving belt 182 shown in FIG. 9. The positions of the mandrels are monitored continuously by computer 216 by a position feedback device (not shown) on the mandrels. As mandrel 20 retracts, hook 74 stays connected to distal end 21. Hook 74 is mounted through a linear bearing to shaft 76 (FIG. 2). Hook 74 is biased by an air cylinder (not shown) to move to the left (as viewed in FIG. 2). Accordingly, rolls 12A–12D will be drawn to the left against pusher plate 274 into a position that avoids later interference with rolls 10A–10E.

The system will verify the execution of a proper response by monitoring the signals associated with hook 74, mandrel 20, lead screw mechanism 264, and pneumatic actuator 270.

In step 298 a flashing, virtual pushbutton will be displayed on touch screen 246 labeled "Raise Cart to Lower Mandrel." When this pushbutton is pressed (in the automatic mode the process proceeds without requesting or awaiting a manual signal from an operator), computer 216, operating automatically through block 234, will pull chain 102 and lift platform 92 (FIG. 4). Platform 92 will rise until reaching the position shown in FIG. 14C. At this time, a pressure sensitive mat (load sensor) on platform 92 will relay a weight signal through block 234 to computer 216 as indicated by step 300. In response, computer 216 will stop platform 92, as indicated by step 302.

If instead, the system is in the "fully manual" mode, then platform 92 will only move when the operator is pressing the virtual pushbutton. In this latter case, the operator will observe the motion of the platform 92 in order to pilot it into a position for supporting the rolls 10A–10E.

In step 304 a flashing, virtual pushbutton will be displayed on screen 246 with the label "Lower Mandrel Retract." If this pushbutton is pressed (in the automatic mode the process proceeds without requesting or awaiting a manual signal from an operator), computer 216, operating through block 228, will circulate belt 182 (FIG. 9) to retract journal 174 and mandrel 18 to the position shown in FIG. 14C. Accordingly, rolls 10A–10E will be totally supported on the right end of platform 92. Also, by providing a virtual, flashing pushbutton labeled "Lower Mandrel Retract" the operator can signal a command through computer 216 and block 236 to operate lead screw mechanism 264 and retract pusher plate 268 to the position shown in FIG. 14D (in the automatic mode the process proceeds without requesting or awaiting a manual signal from an operator).

Figure 16C:
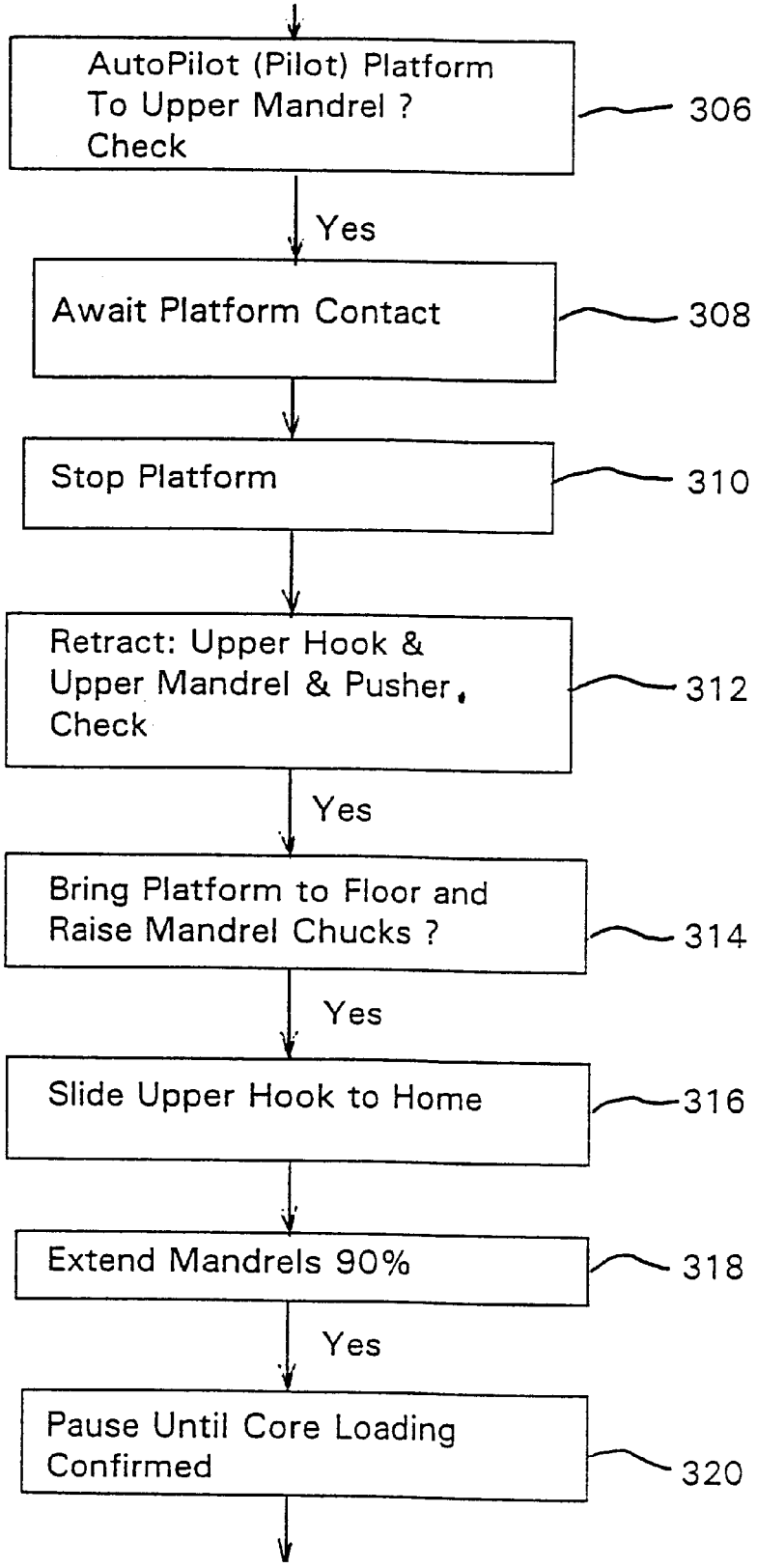

In step 306 (FIG. 16C) computer 216 displays on touch screen 246 a flashing, virtual pushbutton labeled "Raise Cart to Upper Mandrel." If this pushbutton is pressed by the operator (in the automatic mode the process proceeds without requesting or awaiting a manual signal from an operator), computer 216, operating through block 234, will pull chain 102 (FIG. 4) to lift platform 92. Platform 92 will rise with rolls 10A–10E until reaching the position shown in FIG. 14D. At this time, a pressure sensitive mat (load sensor) on the left of platform 92 will relay a weight signal through block 234 to computer 216 as indicated by step 308. In response, computer 216 will stop platform 92 as indicated by step 310.

If instead, the system is in the "fully manual" mode then platform 92 will only move when the operator is pressing the virtual pushbutton. In this latter case, the operator will observe the motion of the platform 92 in order to pilot it into a position for supporting the rolls 12A–12D.

Next in step 312, computer 216 retracts hook 74 from the distal end 21 of mandrel 20. Also, computer 216 retracts journal 174' and mandrel 20 to the position shown in FIG. 14D. Consequently, all rolls now rest on platform 92.

Figure 14E:
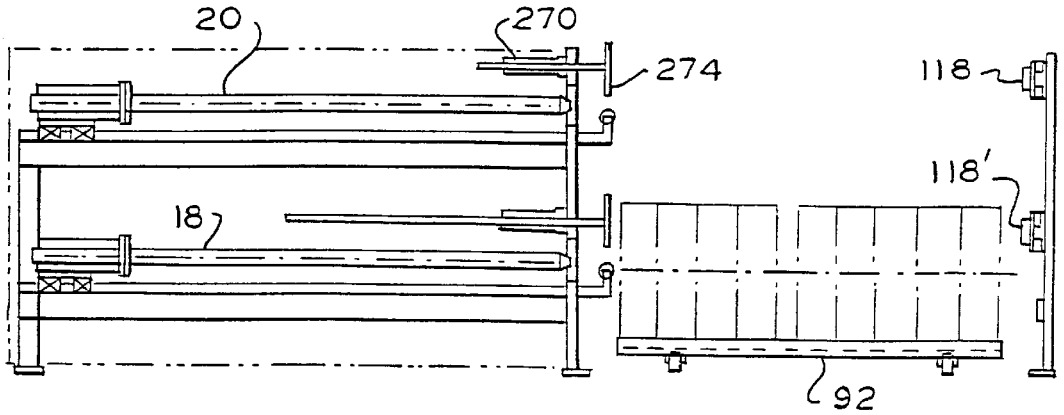

Next, computer 216 operates a pneumatic cylinder (not shown) to retract pusher plate 274 to the position shown in FIG. 14E. The signals associated with the foregoing operation of hook 74 and upper mandrel 20 are monitored to verify proper operation.

In step 314 computer 216 displays on touch screen 246 a virtual, flashing pushbutton labeled "Cart Down to Unload Rolls." While this pushbutton is pressed (in the automatic mode the process proceeds without requesting or awaiting a manual signal from an operator), computer 216, operating through block 234, lowers platform 92 to the floor as shown in FIG. 14E. When platform 92 reaches the ground, lower follower wheel 96 (FIG. 11) swings back along spur 100 allowing platform 92 to tilt, so that rolls 10A–10E and 12A–12D will roll off the platform 92.

In step 316, the air cylinder associated with hook 74 will slide the hook along shaft 76 to the home position next to frame 78. At this time, computer 216, operating through block 238, will pneumatically lift plates 116 and 116' to raise the chucks 118 and 118' into notches 120 and 120' (FIGS. 2 and 5) to reach the positions shown in FIG. 14E.

Figure 15A:
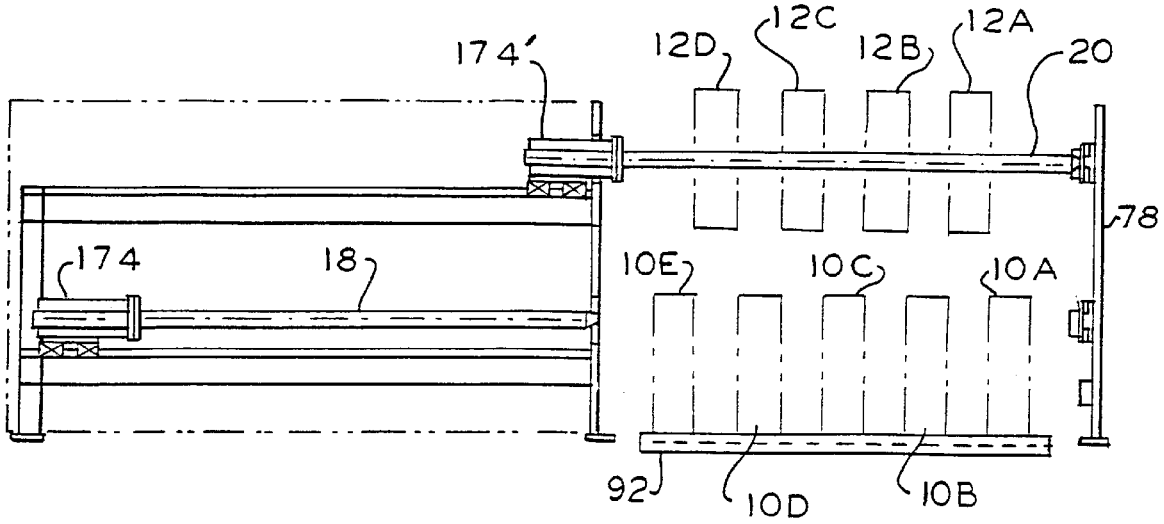
FIGS. 15A and 15B show a sequence of operations being performed by the rewinder of FIG. 2 in an automatic discrete mode.

While the foregoing described a manual shared mode (and indicated the differences from an automatic shared mode), in a manual or automatic discrete mode, the platform can remove rolls from one mandrel and deliver the rolls to the production floor before the platform returns to unload rolls from the other mandrel. As shown in FIG. 15A, platform 92 can support rolls 10A–10E after mandrel 18 is withdrawn. In this case however, rolls 10A–10E are not pushed together but remain separated as shown. Eventually, platform 92 descends to allow rolls 10A–10E to roll onto the production floor.

Figure 15B:
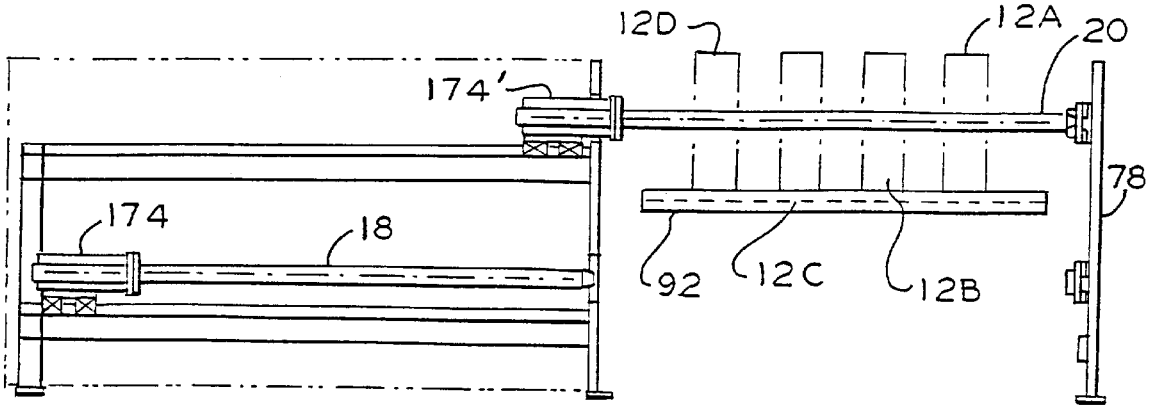

In this discrete mode, the platform 92 now rises to support rolls 12A–12D as shown in FIG. 15B. Thereafter, mandrel 20 can be withdrawn so that rolls 12A–12D are fully supported on platform 92. Finally, platform 92 descends to allow rolls 12A–12D to roll onto the production floor.

Figure 14F:
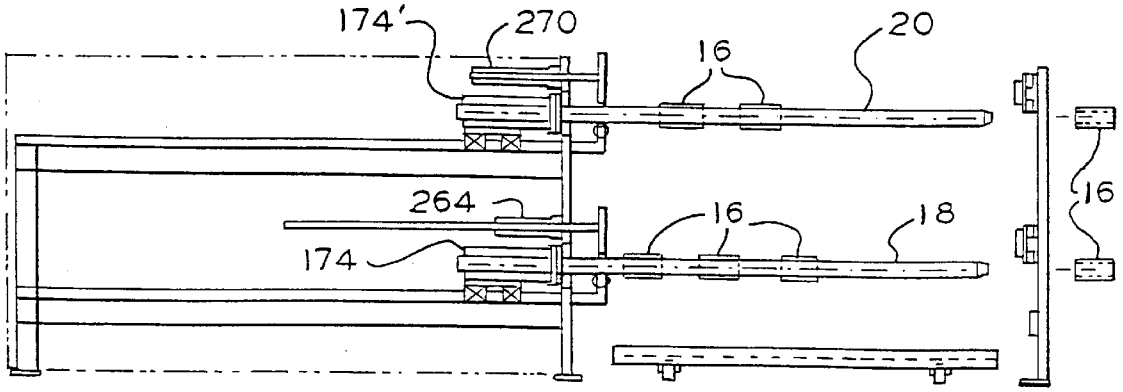

Regardless of the mode (shared or discrete), in step 318 (FIG. 16C) computer 216 will now display on touch screen 246 a virtual, flashing pushbutton labeled "Extend Both Mandrels 90%." While this pushbutton is pressed, computer 216, operating through block 228, will move journals 174 and 174' and mandrels 18 and 20 until reaching a position constituting a 90% extension of the mandrels, as shown in FIG. 14F, at which point the mandrels automatically stop. This 90% extension allows cores 16 to be inserted through the spaces vacated by sliding plates 116 and 116' and onto mandrels 18 and 20, as shown in FIG. 14F.

Figure 16D:
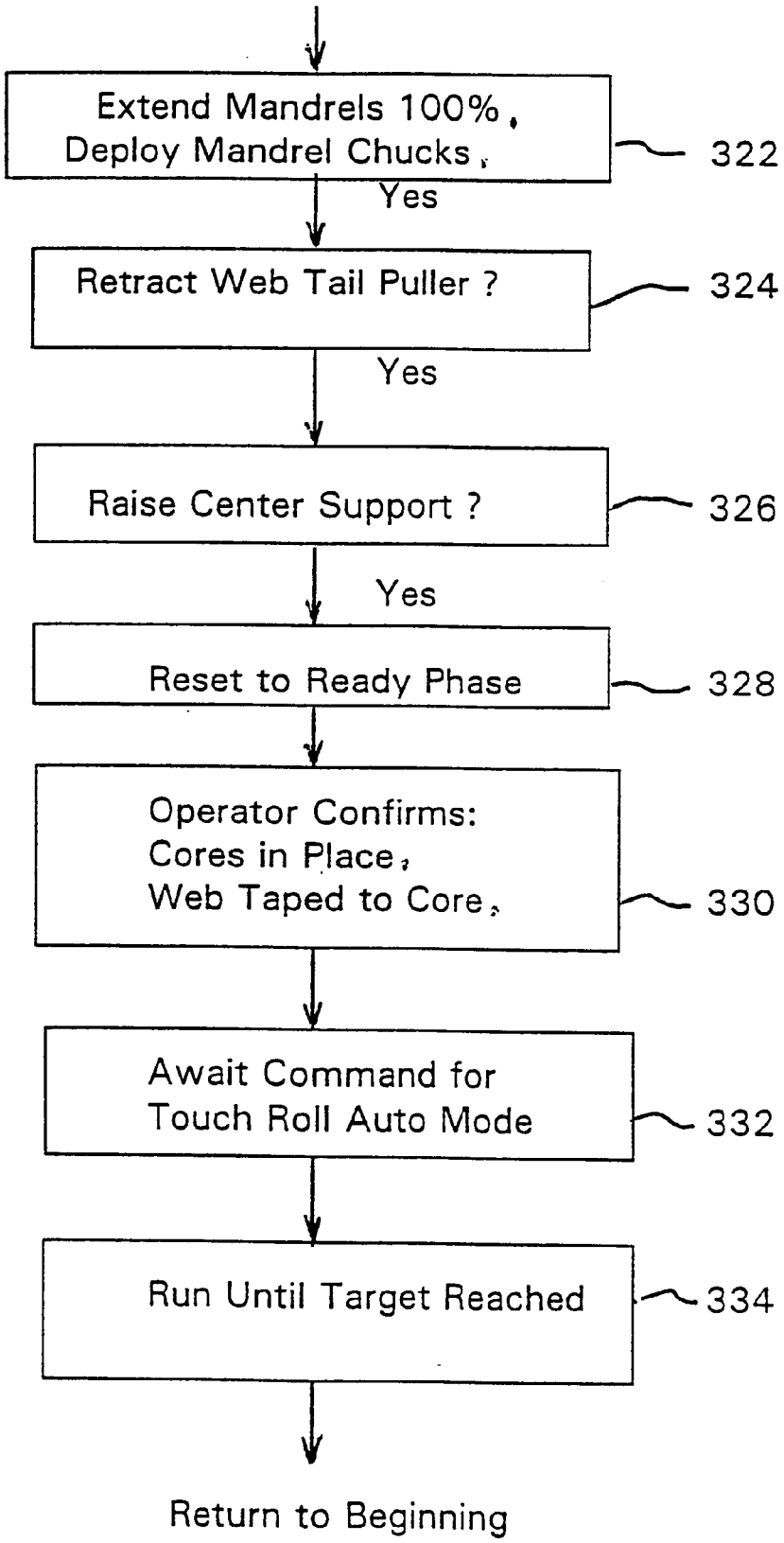

In step 320 computer 216 will pause and display on touch screen 246 the message "Operator to Load Cores on Both Upper and Lower Mandrels." Computer 216 will also display on touch screen 246 a virtual, flashing pushbutton labeled "Operator Procedure Completed." If this pushbutton is pressed, computer 216 will display in succeeding step 322 (FIG. 16D) a flashing, virtual pushbutton on touch screen 246 labeled "Extend Both Mandrels 100%." While this pushbutton is pressed (in the automatic mode the process proceeds without requesting or awaiting a manual signal from an operator), computer 216, operating through block 238, will lower the supporting plates 116 and 116' to place the chucks 118 and 118' (FIGS. 2 and 5) in alignment with mandrels 18 and 20. Next, so long as the above virtual pushbutton is pressed, computer 216, operating through block 228, will fully extend mandrels 18 and 20 until their distal ends 19 and 21 engage chucks 118 and 118'. At this time the mandrels will automatically stop at 100% extension.

In succeeding step 324, computer 216 will display a flashing, virtual pushbutton on touch screen 246 labeled "Retract Web Tail Puller." If this pushbutton is pressed (in the automatic mode the process proceeds without requesting or awaiting a manual signal from an operator), computer 216, operating through block 243, will lower bars 106 and 108 (FIGS. 3 and 4). In succeeding step 326, computer 216 will display a flashing, virtual pushbutton on touch screen 246 labeled "Center Supports Raise." If this pushbutton is pressed (in the automatic mode the process proceeds without requesting or awaiting a manual signal from an operator), computer 216, operating through block 232, will pneumatically rotate lever 65 (FIG. 4) to rotate arms 62 and 68 into position to support the centers of mandrels 20 and 18.

It will be understood that any of the foregoing unloading procedures can be interrupted by depressing the unload sequence stop button 256 (FIG. 13).

The system will now prepare for a new rewinding phase by resetting various parameters in step 328. For example, the system will reset the counters associated with registering the amount of web rewound onto the mandrels. Also, the operator can review and alter the various parameters entered into computer memory 218 as described above in connection with step 276.

The operator may now use jog button 250 (FIG. 13) to slowly advance the web and allow the operator to the tape the incoming web to the cores 16. The operator can then confirm completion of this procedure by pressing a virtual pushbutton displayed on touch screen 246 as indicated in step 330. The operator can also set the touch rolls 54 and 68 to operate in an automatic mode and direct them to move against the rolls 10 and 12 as indicated in step 332.

Computer 216 will also allow the operator to control various elements through virtual pushbuttons presented on screen 246. For example, the operator can operate the main brake, position the web guide, and place the web guide in a manual or automatic mode. The web guide is a motor-driven system for axially repositioning the supply roll 22. The operator will also be given control over the equipment associated with supply roll 22. Specifically, the operator can operate the chucks supporting the supply roll 22, as well as adjust the elevation of supply roll 22. The operator will also be able to select brake pucks that are used with the supply roll 22.

The operator will also be able to specify whether the rewinding proceeds with the cores 16 either slipping or locked into position on the mandrels 18 and by gripping tabs 84 and 86. The operator can also select the direction of rotation of the mandrels so that the web can approach from above or below. Also, the slitter may produce some trimming waste that can be removed by a vacuum system, which is under the control of the operator. In addition, certain nip rolls can be made active or inactive based on selections by the operator.

Once these settings are accomplished and machine interlocks are completely satisfied, the operator can begin the rewinding process of step 334 by pressing "run" pushbutton 248 on panel 244. Supply roll 22 will then be paid out and web 24 pulled by driven rollers 32 and 36 (FIG. 4). Web 24 can then be slit into a number of narrower webs by means of the slitter combination 42, 44. Driven rollers 50 and 56 pull the slitted webs and deliver them over touch rolls 54 and 60 to the rolls 10 and 12.

The operator can also adjust the target speed that should be reached after initial acceleration, by adjusting knob 260 (FIG. 13). The operator can also manually adjust the tension of the web as delivered by supply roll 22, by adjusting knob 262.

Beams 146 (FIG. 7) can be retracted so that the touch rolls 54 and 60 do not produce excessive pressure as the rewinding rolls 10 and 12 grow. By operating motor 136 to rotate pinion 134, bracket 144 and beam 146 retract with the growth of the rewinding rolls 10 and 12. Motor 136 is operated intermittently in response to the photo sensor 154 signaling that more room is needed for growth.

The pressure asserted by air cylinder 168 (FIG. 8) causes touch rolls 54 and 60 to apply an appropriate pressure to rewinding rolls 10 and 12. As discussed previously, this touch pressure can vary during the course of the rewinding. In addition to winding with touch rolls 54 and 60 kept in contact with rewinding rolls 10 and 12, there is an additional mode that maintains a small constant gap between the touch rolls and rewinding rolls (gap mode). Diameter feedback from rolls 10 and 12 is compared to positional feedback for beams 146, and motor 136 operates to position rolls 54 and 60 accordingly (under these circumstances rolls 54 and 60 are referred to as flanking rolls). There are separate independent systems for operating each beam 146. In other embodiments, there could be a single central system working in conjunction with beams 146 that are linked to operate together.

If an emergency occurs, the operator can stop the rewinding process by depressing button 258 (FIG. 13). This will bring the machine to a sudden stop. Thereafter, the operator can depress the "Emergency Stop Reset" button 252 to restore various registers in computer 216 to the pre-stop condition, provided all other safety conditions are met. In less urgent situations, the machine can be stop by pressing "Machine Stop" button 254. This will cause the machine to decelerate to a controlled stop.

As the rewinding rolls 10 and 12 grow, counters inside a computer 216 keep track of the amount of rewinding, awaiting the delivery of a full load onto cores 16. When the rolls 10 and 12 grow to the desired diameter or web length, computer 216 can automatically decelerate mandrels 18 and 20. Thereafter, an unloading procedure can be performed as described previously.

It is appreciated that various modifications may be implemented with respect to the above described, preferred embodiments. While two mandrels are disclosed, in other embodiments a different number of mandrels may be employed. Also the length of the mandrels as well as the number of cores supported by the mandrels can be different in different embodiments. Additionally, while inflation-operated gripping tabs and locating tabs are shown, in other embodiments the gripping and locating can be performed by other mechanical means. Furthermore, the steps of the flow chart can be performed in an order different than that described above. Moreover, in other embodiments steps can be added or deleted. While various supports are shown for the center and end of the mandrels, in other embodiments a greater or lesser number of supports may be employed. Also, while swinging hooks or arms are shown, other embodiments may employ supports that are moved into a working position linearly. Furthermore, some embodiments may eliminate the sliding plates supporting the chucks for the distal ends of the mandrels in which case, the mandrels may be extended an amount different than 90% when loading the cores. Also, the dimensions, materials, shapes, and locations of the various components described herein may be varied depending upon the desired strength, capacity, clearance, rigidity, etc.

Obviously, many modifications and variations of the present invention are possible in light of the above teachings. It is therefore to be understood that within the scope of the appended claims, the invention may be practiced otherwise than as specifically described.

What is claimed is:

1. A rewinder for rewinding a web into one or more rolls on separate cores, comprising:

at least a first and a second rewinding mandrel each having a distal end;

supply means for supplying said web to said rewinding mandrels;

drive means for (a) rotating said rewinding mandrels in order to wind at least a portion of said web onto said rewinding mandrels, and (b) axially retracting said mandrels to unload the portion of the web wound on said mandrels;

a holder for holding said one or more rolls;

lift means for (a) raising said holder to support selectively the portion of the web wound on either one of said first and said second mandrel, and (b) lowering said holder; and control means coupled to said lift means and said drive means for sequentially operating them and for selectively bringing said holder to either one of said first and said second mandrel.

2. A rewinder according to claim 1 comprising:

a follower mounted on said holder; and a vertical guide for guiding said holder and said follower, said guide having a lower spur for diverting said follower and tilting said holder in order to discharge the one or more rolls held on said holder.

3. A rewinder according to claim 1 wherein said holder comprises:

a platform; and at least one caster, said lift means being located between said platform and said at least one caster for elevating and lowering said platform.

4. A rewinder according to claim 1 wherein said control means comprises:

a digital processor means having memory for sequencing operations of said lift means and said drive means.

5. A rewinder according to claim 4 wherein said control means is operable to accelerate said mandrel toward a preset linear web speed, reducing angular speed of said mandrel as the one or more rolls increase in diameter.

6. A rewinder according to claim 5 wherein said control means is operable to accelerate said mandrel and limit then to a predetermined maximum angular speed in order to prevent excessive vibration.

7. A rewinder according to claim 6 wherein said control means is operable to rotate said mandrel to make their revolution rate exceed the ratio of the preset linear web speed to circumference of one of the one or more rolls, in order to allow slip between said mandrel and said one or more rolls.

8. A rewinder according to claim 4 wherein said control means comprises:

a manually operable input device for storing in said memory at least one profile of operating parameters, each profile including one or more of: expected web thickness, expected web width, targeted web length and targeted web winding diameter on a finished one of the one or more rolls.

9. A rewinder according to claim 8 wherein said manually operable input device is operable to store in said memory, in said at least one profile of operating parameters, one or more of: winding tension onto said mandrels, mandrel, and unwinding tension from said supply means.

10. A rewinder according to claim 8 comprising:

a touch roll mounted at at least of one said mandrels for bearing against said one or more rolls during winding, said touch roll being retractable as said one or more rolls increase in diameter to regulate pressure on one of the one or more rolls, said manually operable input device being operable to store in said memory, in said at least one profile of operating parameters, targeted pressure from said touch roll.

11. A rewinder according to claim 9 comprising:

a flanking roll mounted at said mandrel for flanking said one or more rolls during winding, said flanking roll being retractable as said one or more rolls increase in diameter to maintain a gap from one of said one or more rolls, said manually operable input device being operable to store in said memory, in said at least one profile of operating parameters, targeted spacing between said flanking roll and said one or more rolls.

12. A rewinder according to claim 8 wherein said control means is operable to store and recall a plurality of the profiles of operating parameters.

13. A rewinder according to claim 8 wherein said control means is operable to count the accumulating web length wound onto one of the one or more rolls and to decelerate and stop rotation of said mandrel as the accumulating web length approaches the targeted web length.

14. A rewinder according to claim 1 wherein said control means is operable in an automatic shared mode to raise said holder in order to successively receive said one or more rolls from said first mandrel and said second mandrel before lowering said holder loaded with said one or more rolls from both said first mandrel and said second mandrel.

15. A rewinder according to claim 14 wherein said control means is operable in an automatic discrete mode to (a) to raise said holder in order to receive said one or more rolls from said first mandrel, and (b) lower said holder loaded with said one or more rolls from said first mandrel before rising to unload said second mandrel.

16. A rewinder according to claim 15 wherein said control means is operable in an automatic log mode, where only said first mandrel is wound, to (a) raise said holder in order to receive one of said one or more rolls from said first mandrel, and (b) lower said holder loaded with one of said one or more rolls from said first mandrel without rising to unload said second mandrel.

17. A rewinder according to claim 1 wherein said control means is operable to (a) raise said holder to support the one or more rolls from said first mandrel, (b) retract said first mandrel to deliver said one or more rolls from said first mandrel to said holder, (c) raise said holder to support the one or more rolls from said second mandrel, and (d) retract said second mandrel to deliver the one or more rolls from said first mandrel to said holder.

18. A rewinder according to claim 14, comprising:

a load sensor on said holder and coupled to said control means for producing a weight signal for interrupting the rise of said holder upon said weight signal being produced in response to said one or more rolls being first supported on said holder.

19. A rewinder according to claim 17 wherein said first and said second mandrel each have gripping means coupled to said control means for selectively holding and releasing said separate cores in place, said control means being operable to release said separate cores from said gripping means of said first and said second mandrel before retracting said first and said second mandrel, respectively.

20. A rewinder according to claim 1 wherein said control means is operable to partially extend said mandrel to permit loading thereon of said separate cores.

21. A rewinder according to claim 1 comprising:

a retractable end support coupled to said control means for supporting the distal end of said mandrel when fully extended, said control means being operable to partially extend said mandrel and retract said end support to provide clearance for loading said separate cores on said mandrel.

22. A rewinder according to claim 1 wherein each of said mandrels have a distal end, said rewinder comprising:

grappling means for supporting the distal end of the higher one of said first and said second mandrel and for continuing such support as the drive means retracts said higher one.

23. A rewinder according to claim 1 wherein each of said one or more rolls can be severed to produce an incoming cut end, said rewinder comprising:

a tail support coupled to said control means and reciprocatably mounted adjacent to at least one of said mandrels for moving relative to said one or more rolls in order to support the incoming cut end of said web.

24. A rewinder according to claim 1 comprising:

a retractable center support for centrally supporting a supportable one of said mandrels, said center support being operable by said control means to retract said center support before retracting said supportable one of said mandrels.

25. A rewinder according to claim 24 wherein said retractable center support comprises:

an arm mounted to swing under said at least one mandrel.

26. A rewinder according to claim 1 wherein said rewinder comprises:

a first and a second retractable center support for centrally supporting said first and said second mandrel, respectively, said first and said second center support being operable to retract before retraction of said first and said second mandrel, respectively.

27. A rewinder according to claim 1 comprising:

a first urging means mounted at said first mandrel for urging said one or more rolls on said first mandrel toward a predetermined side of said rewinder.

28. A rewinder according to claim 27 comprising:

a second urging means mounted at said second mandrel for urging said one or more rolls on said second mandrel toward a side opposite said predetermined side.

29. A rewinder according to claim 27 wherein said first urging means is operable to move toward the distal end all of the one or more rolls on the first mandrel, said first mandrel being lower than said second mandrel.

30. A rewinder according to claim 1 wherein said drive means comprises:

a pair of journal mounted to rotatably support said mandrel and to axially shift and retract said mandrels.

31. A rewinder according to claim 30 comprising:

an axially movable motor for rotating said mandrels and for moving with said journals.

32. A rewinder according to claim 30 comprising:

a pair of axially stationary drive rotors, said journals each having engagement means for engaging and disengaging said drive rotors in response to axial motion of said journals.

33. A rewinder according to claim 32 comprising:

at least one spring-loaded pin mounted between each of said drive rotor and said engagement means for releasably engaging them.

34. A rewinder according to claim 30 comprising for each of said journals:

an axially extending track for supporting a corresponding one of said journals and permitting it to shift axially; and means connected to said corresponding one of said journals for moving it along said track.

35. A rewinder according to claim 34 wherein each of said mandrel comprises:

a shaft;

a first and a second inflatable bladder mounted inside said shaft;

a plurality of gripping tabs slidably mounted upon said shaft to radially deploy in response to inflation of said first inflatable bladder; and a plurality of locating tabs slidably mounted upon said shaft to radially deploy in response to inflation of said second inflatable bladder.

36. A rewinder according to claim 35 comprising at each of said mandrels:

a touch roll mounted at said mandrel for bearing against said one or more rolls during winding, said touch roll being retractable as said one or more rolls increase in diameter.

37. A rewinder according to claim 35 comprising at each of said mandrels:

a flanking roll mounted at said mandrel for flanking said one or more rolls during winding, said flanking roll being retractable as said one or more rolls increase in diameter to maintain a gap from said one or more rolls.

38. A rewinder according to claim 36 wherein said supply means comprises:

a slitter for slitting said web into a plurality of separate webs.

39. A method employing a controller, a holder and at least a first and a second, elevationally spaced rewinding mandrels for rewinding a web into one or more rolls on separate cores, comprising the steps of:

rotating one or more of said rewinding mandrels in order to wind at least a portion of said web onto one or more of said rewinding mandrels;

raising said holder under the supervision of said controller to support selectively the portion of the web wound on either one of said mandrels;

axially retracting the selected one of said mandrels under the supervision of said controller to unload the portion of the web wound on said mandrel; and lowering said holder under the supervision of said controller to an elevation below both of said mandrels.

40. A method according to claim 39 comprising the step of:

tilting said holder in order to discharge the one or more rolls on said holder.

41. A method according to claim 39 comprising the step of:

moving said holder away from said mandrel to an unloading location;

operating said holder in order to discharge the one or more rolls on said holder.

42. A method according to claim 39 comprising the steps of:

accelerating said mandrel toward a preset linear web speed; and reducing angular speed of said mandrel as the one or more rolls increase in diameter.

43. A method according to claim 42 comprising the step of:

accelerating said mandrel and limiting them to a predetermined maximum angular speed in order to prevent excessive vibration.

44. A method according to claim 43 comprising the step of:

rotating said mandrel to make their revolution rate exceed the ratio of the preset linear web speed to circumference of one of the one or more rolls, in order to allow slip between said mandrel and said one or more rolls.

45. A method according to claim 39 employing at each of said mandrels a touch roll mounted at said mandrel for bearing against said one or more rolls during winding, said method comprising the step of:

retracting said touch roll as said one or more rolls increase in diameter to regulate pressure on one of the one or more rolls.

46. A method according to claim 39 employing at each of said mandrels a flanking roll mounted at said mandrel for flanking said one or more rolls during winding, said method comprising the step of:

retracting said flanking roll as said one or more rolls increase in diameter to maintain a gap between said flanking roll and one of the one or more rolls.

47. A method according to claim 39 comprising the steps of:

counting the current web length wound onto one of the one or more rolls; and decelerating and stopping rotation of said mandrel as the current web length approaches a targeted web length.

48. A method according to claim 39 in an automatic shared mode comprising the step of:

raising said holder in order to successively receive said one or more rolls from said first mandrel and said second mandrel before lowering said holder loaded with said one or more rolls from both said first mandrel and said second mandrel.

49. A method according to claim 48 operating in an automatic discrete mode and comprising the steps of:

raising said holder in order to receive said one or more rolls from said first mandrel; and lowering said holder loaded with said one or more rolls from said first mandrel before rising to unload said second mandrel.

50. A method according to claim 49 operating in an automatic log mode where only said first mandrel is wound, and comprising the steps of:

raising said holder in order to receive one of said one or more rolls from said first mandrel; and lowering said holder loaded with one of said one or more rolls from said first mandrel without rising to unload said second mandrel.

51. A method according to claim 39 comprising the steps of:

raising said holder to support the one or more rolls from said first mandrel;

retracting said first mandrel to deliver said one or more rolls from said first mandrel to said holder;

raising said holder to support the one or more rolls from said second mandrel; and retracting said second mandrel to deliver the one or more rolls from said first mandrel to said holder.

52. A method according to claim 39 comprising the step of:

partially extending said mandrel to permit loading thereon of said separate cores.

53. A method according to claim 39 employing for each of the mandrels a retractable end support for supporting the distal end of said mandrels when fully extended, said method comprising the step of:

retracting said end supports and extending said mandrels partially to provide clearance for loading said separate cores on said mandrel.

54. A method according to claim 39 wherein said mandrels each have a distal end, said method comprising the step of:

supporting the distal end of the higher one of said first and said second mandrel and for continuing such support as said higher one is retracted.

55. A method according to claim 39 comprising the steps of:

severing each of said one or more rolls to produce an incoming cut end; and supporting the incoming cut end of said web.

56. A method according to claim 39 comprising the steps of:

centrally supporting said mandrels; and ceasing central support of said mandrels before retracting said mandrels.

57. A method according to claim 39 comprising the steps of:

centrally supporting said first and said second mandrel; and ceasing central support of said first and said second mandrel before retraction of said first and said second mandrel, respectively.

58. A method according to claim 39 wherein each of said mandrels have a distal end, comprising the step of:

moving said one or more rolls on said first mandrel toward a predetermined side of said rewinder.

59. A method according to claim 58 comprising the step of:

moving said one or more rolls on said second mandrel toward a side opposite said predetermined side.

60. A method according to claim 58 comprising the step of:

moving to the distal end all of the one or more rolls on the first mandrel, said first mandrel being lower than said second mandrel.

61. A method according to claim 60 comprising the step of:

slitting said web into a plurality of separate webs.

* * * * *